US006970660B2

(12) United States Patent
Harada et al.

(10) Patent No.: US 6,970,660 B2
(45) Date of Patent: Nov. 29, 2005

(54) IMAGE ADJUSTMENT METHOD AND IMAGE FORMING APPARATUS

(75) Inventors: Yoshikazu Harada, Nara (JP); Kyosuke Taka, Nara (JP); Nobuo Manabe, Yamatokooriyama (JP); Norio Tomita, Yamatokooriyama (JP); Toshio Yamanaka, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 83 days.

(21) Appl. No.: 10/655,677

(22) Filed: Sep. 5, 2003

(65) Prior Publication Data

US 2004/0047659 A1 Mar. 11, 2004

(30) Foreign Application Priority Data

Sep. 6, 2002 (JP) ..... 2002-262067

(51) Int. Cl.[7] ..... G03G 15/00
(52) U.S. Cl. ..... 399/49; 399/301; 347/116
(58) Field of Search ..... 399/49, 66, 72, 399/301, 299; 347/116

(56) References Cited

U.S. PATENT DOCUMENTS 5,122,835 A * 6/1992 Rushing et al. ..... 399/49
5,768,671 A * 6/1998 Komiya et al. ..... 399/301
5,867,759 A * 2/1999 Isobe et al. ..... 399/301
5,933,680 A * 8/1999 Nishimura ..... 399/49
6,044,234 A * 3/2000 Yoshizawa ..... 399/49
6,148,168 A 11/2000 Hirai et al. ..... 399/301
6,295,435 B1 * 9/2001 Shinohara et al. ..... 399/301

FOREIGN PATENT DOCUMENTS

JP 03042693 A * 2/1991 ..... G03G 15/08
JP 10-213940 8/1998
JP 2000-081744 3/2000
JP 2000221738 A * 8/2000 ..... G03G 15/00
JP 2001-312116 11/2001

* cited by examiner

*Primary Examiner*—Robert Beatty
(74) *Attorney, Agent, or Firm*—David G. Conlin; David A. Tucker; Edwards & Angell, LLP

(57) ABSTRACT

An image adjustment method for an image forming apparatus in which an adjustment image is formed by transferring a plurality of reference images formed by a color component to be the reference among a plurality of color components and a plurality of images to be adjusted, which are formed by other color component to be adjusted, onto a transfer medium so that the images to be adjusted are superposed on the reference images, the density of the formed adjustment image is detected, and an image forming position of the other color component to be adjusted is adjusted based on the detected density of the adjustment image. The density of the surface of the transfer medium is detected, and the position of forming the image to be adjusted is adjusted, based on the detected density of the surface of the transfer medium and the detected density of the adjustment image.

12 Claims, 14 Drawing Sheets

IMAGE ADJUSTMENT METHOD AND IMAGE FORMING APPARATUS

BACKGROUND OF THE INVENTION

1. Field of the Invention

The present invention relates to an adjustment method such as a color registration adjustment for an electrophotographic type image forming apparatus, and an image forming apparatus, and more specifically relates to an image adjustment method and an image forming apparatus which are capable of automatically adjusting misregistration of a multi-color image which occurs when forming the multi-color image by superposing color component images formed on an image carrier (image forming means: photoconductor drum) or a transfer carrier (transfer medium: transfer belt, paper).

2. Description of Related Art

In an image forming apparatus such as a digital color copying machine, after decomposing inputted data into a plurality of color components and performing image processing, the respective color component images are superposed to form a multi-color image. When the images formed by the respective color components are not accurately superposed during the forming a multi-color image, misregistration occurs in the resultant multi-color image, and the image quality deteriorates.

In particular, in an image forming apparatus comprising image forming units, each being used exclusively by each color component, to improve the forming speed of a multi-color image, images are formed by respective color components in the respective image forming units, and then the images formed by the respective color components are superposed one upon another to form a multi-color image. In such an image forming apparatus, there tend to be differences in the transfer positions of the images formed by the respective color components, and consequently there arises a serious problem of misregistration of the multi-color image.

Therefore, in order to accurately superpose the images formed by the respective color components, an image forming apparatus is designed to perform a color registration adjustment to adjust the misregistration of a multi-color image, and thereby form a satisfactory multi-color image having no misregistration.

The color registration adjustment is usually carried out by using an optical detector to detect a displacement of the image forming position of other color component with respect to the image forming position of a color component to be the reference. Based on the result of the detection, an adjusting amount is determined. Then, according to the adjusting amount, the timing of forming an image by each color component is adjusted so that the transfer positions of the images formed by the respective color component images coincide with each other. In general, the images formed by the respective color components are transferred at the same timing, and the distance between the transfer positions of the images formed by the respective color components is detected, or the density of a multi-color image formed by superposing the images of respective color components is detected.

For example, in an image forming apparatus disclosed in Japanese Patent Application Laid-Open No. 10-213940 (1998), the distance between the transfer positions of the images formed by the respective color components is detected, and an adjustment is made based on the detected amount of displacement between the transfer positions.

Specifically, the distance between an image formed by a color component to be the reference and an image formed by other color component is detected with a detector, and the amount of displacement between the transfer positions of the images formed by the respective color components is determined based on the detected distance, thereby adjusting the misregistration.

Further, Japanese Patent Application Laid-Open No. 2000-81744 discloses an image forming apparatus which measures the density of a multi-color image formed by superposing images formed by respective color components, and adjusts misregistration so that the measured density becomes equal to a density of a state in which the images formed by the respective color components are accurately superposed.

In this image forming apparatus, in order to improve the adjustment accuracy, an image to be formed by each color component is formed by repeatedly forming a plurality of same images. A plurality of line images are formed as the same images, and the density of a multi-color line image is detected with a detector to find the superposed state of the line images formed by the respective color components. Then, a state in which the density of the multi-color line image detected with the detector is within a predetermined density range is regarded as a state in which the line images formed by the respective color components are accurately superposed, and an adjustment is made so that image forming is performed in this superposed state, thereby performing the color registration adjustment.

In the image forming apparatus of Japanese Patent Application Laid-Open No. 10-213940 (1998), since the displacement between the transfer positions of the respective images is found using the detector for detecting the transfer positions of the images formed by the respective color components, there is a problem that a detector with high detection accuracy needs to be used to detect a very small displacement between the transfer positions.

On the other hand, in the image forming apparatus disclosed in Japanese Patent Application Laid-Open No. 2000-81744, since an adjustment value for a state in which the reference image and the image formed by a color component to be adjusted perfectly overlap is found by detecting densities while shifting the adjustment value on a line by line basis over the entire image color registration adjustment range, this apparatus has the advantage that there is no need to use a detector with high detection accuracy.

However, both of these image forming apparatuses are susceptible to the following problems: an erroneous detection result may be obtained due to a surface condition (particularly, scratches) of a transfer unit where images are formed; an error may occur during the execution of color registration adjustment, and the quality of the formed image may rather deteriorate after the color registration adjustment. These problems appear particularly in a type of apparatus in which the detector detects specular reflected light. These problems are also described in Japanese Patent Application Laid-Open No. 2001-312116.

BRIEF SUMMARY OF THE INVENTION

The present invention has been made with the aim of solving the above-mentioned problems, and it is an object of the present invention to provide an image adjustment method for an image forming apparatus, and an image forming apparatus, which are capable of obtaining a correct density detection result in a stable manner, shortening the time requiring color registration adjustment, and implementing highly accurate color registration adjustment.

According to a first aspect of the image adjustment method of the present invention, there is provided an image adjustment method for an image forming apparatus, comprising the steps of forming an adjustment image by transferring and superposing onto a transfer medium a plurality of reference images formed by a color component to be a reference among a plurality of color components and a plurality of images to be adjusted, which are formed by other color component to be adjusted; detecting a density of the formed adjustment image; and adjusting an image forming position of the other color component to be adjusted, based on the detected density of the adjustment image, the method being characterized by further comprising the step of detecting a density of a surface of the transfer medium; and the step of adjusting the image forming position of the other color component, based on the detected density of the surface of the transfer medium and the detected density of the adjustment image.

According to a first aspect of the image forming apparatus of the present invention, there is provided an image forming apparatus comprising: a plurality of image forming means for forming images by a plurality of color components, respectively; a plurality of transferring means for transferring the images formed by the plurality of image forming means onto a transfer medium so as to superpose the images; first detecting means for detecting a density of an adjustment image which is formed by transferring and superposing onto the transfer medium by the plurality of transferring means a plurality of reference images formed by a color component to be a reference among the plurality of color components and a plurality of images to be adjusted, which are formed by other color component to be adjusted; and adjusting means for adjusting an image forming position of the other color component, based on the density detected by the first detecting means, the image forming apparatus being characterized by further comprising: the image forming apparatus further comprising: second detecting means for detecting a density of a surface of the transfer medium, whereby the image adjusting means adjusts the image forming position of the other color component, based on the density detected by the second detecting means and the density of the adjustment image detected by the first detecting means.

In the first aspect of the image adjustment method of the present invention and the first aspect of the image forming apparatus of the present invention, the respective image forming means forms images corresponding to a plurality of color components, respectively, and the respective transferring means transfers the images formed by the respective image forming means onto a transfer medium so as to superpose the images. The respective transferring means transfers a plurality of reference images formed by a color component to be the reference among the plurality of color components and a plurality of images to be adjusted, which are formed by other color component to be adjusted, onto the transfer medium so that the images to be adjusted are superposed on the reference images, thereby forming an adjustment image. The first detecting means detects the density of the adjustment image thus formed. Then, the adjusting means adjusts an image forming position of the other color component to be adjusted, based on the density detected by the first detecting means. Further, the second detecting means detects the density of the surface of the transfer medium. Based on the density of the surface of the transfer medium detected by the second detecting means and the density of the adjustment image detected by the first detecting means, the image forming position of the other color component to be adjusted is adjusted.

Accordingly, since the result of detecting the density of the adjustment image can be corrected by taking into account the surface condition of the transfer medium (transfer belt, paper), it is possible to detect the density of the adjustment image highly accurately without being influenced by the surface condition of the transfer medium. Consequently, since the maximum value or the minimum value of detected values of the density of adjustment images can be easily obtained, it is possible to prevent erroneous color registration adjustment and obtain correct density detection results in a stable manner. As a result, it is possible to realize an image adjustment method and an image forming apparatus which are capable of shortening the time requiring color registration adjustment and implementing highly accurate color registration adjustment.

According to a second aspect of the image adjustment method of the present invention, there is provided the image adjustment method of the first aspect, wherein the step of detecting the density of the surface of the transfer medium is executed prior to forming the adjustment image, and the adjustment image is formed at same position as a position where the density of the surface of the transfer medium was detected.

According to a second aspect of the image forming apparatus of the present invention, there is provided the image forming apparatus of the first aspect, wherein the second detecting means detects a density of the surface of the transfer medium prior to forming the adjustment image by the transferring means, and the transferring means forms the adjustment image at same position as a position where the density of the surface of the transfer medium was detected by the second detecting means.

In the second aspect of the image adjustment method of the present invention and the second aspect of the image forming apparatus of the present invention, the second detecting means detects the density of the surface of the transfer medium prior to forming the adjustment image by the transferring means. Then, the transferring means forms the adjustment image at the same position as the position where the density of the surface of the transfer medium was detected by the second detecting means. As a result, the transferring means can form the adjustment image at a position where the surface condition of the transfer medium has been known from the detection result of the second detecting means, and it is therefore possible to accurately correct the density of the adjustment image.

According to a third aspect of the image adjustment method of the present invention, there is provided the image adjustment method of the second aspect, wherein the image forming position of the other color component is adjusted based on a difference between the detected density of the adjustment image and the detected density of the surface of the transfer medium.

According to a third aspect of the image forming apparatus of the present invention, there is provided the image forming apparatus of the second aspect, wherein the adjusting means adjusts the image forming position of the other color component, based on a difference between the density of the adjustment image detected by the first detecting means and the density of the surface of the transfer medium detected by the second detecting means.

In the third aspect of the image adjustment method of the present invention and the third aspect of the image forming apparatus of the present invention, the image forming position of the other color component to be adjusted is adjusted based on the difference between the density of the adjustment image detected by the first detecting means and the density of the surface of the transfer medium detected by the second detecting means.

In this case, since the output of the first detecting means obtained when detecting the density of the adjustment image is influenced by the surface condition of the transfer medium (transfer belt, paper), a correct density detection result of the adjustment image can be obtained by subtracting an output obtained by detecting the surface condition (density) of the transfer medium with the second detecting means from the output of the first detecting means.

According to a fourth aspect of the image adjustment method of the present invention, there is provided the image adjustment method of the third aspect, wherein plural sets of the adjustment images are formed by shifting the reference images and the images to be adjusted from each other by a predetermined distance, and a position where a detected value of density, which varies with a distance of shift between the reference image and the image to be adjusted, has a maximum value or a minimum value is determined to be the image forming position of the other color component.

According to a fourth aspect of the image forming apparatus of the present invention, there is provided the image forming apparatus of the third aspect, wherein the transferring means forms plural sets of adjustment images in which the reference images and the images to be adjusted are shifted from each other by a predetermined distance, and the adjusting means determines a position where a detected value of density detected by the first detection means, which varies with a distance of shift between the reference image and the image to be adjusted, has a maximum value or a minimum value to be the image forming position of the other color component.

In the fourth aspect of the image adjustment method of the present invention and the fourth aspect of the image forming apparatus of the present invention, the transferring means forms plural sets of adjustment images in which the reference images and the images to be adjusted are shifted from each other by a predetermined distance, and the adjusting means determines a position where a detected value of density detected by the first detection means, which varies with a distance of shift between the reference image and the image to be adjusted, has a maximum value or a minimum value to be the image forming position of the other color component to be adjusted.

Accordingly, it is possible to realize an image adjustment method and an image forming apparatus which are capable of obtaining correct density detection results in a stable manner, shortening the time requiring color registration adjustment, and implementing highly accurate color registration adjustment.

According to a fifth aspect of the image adjustment method of the present invention, there is provided the image adjustment method of the fourth aspect, wherein the density of the surface of the transfer medium is detected prior to forming the adjustment image every time the adjustment image is formed.

According to a fifth aspect of the image forming apparatus of the present invention, there is provided the image forming apparatus of the fourth aspect, wherein the second detecting means detects the density of the surface of the transfer medium prior to forming the adjustment image every time the transferring means forms the adjustment image.

In the fifth aspect of the image adjustment method of the present invention and the fifth aspect of the image forming apparatus of the present invention, the second detecting means detects the density of the surface of the transfer medium prior to forming the adjustment image every time the transferring means forms the adjustment image. Accordingly, irrespective of the surface condition of the transfer medium which changes every moment with image forming, it is always possible to correct the density of the adjustment image based on a correct surface condition detection result.

According to a sixth aspect of the image adjustment method of the present invention, there is provided the image adjustment method of any one of the first through fifth aspects, wherein the density of the surface of the transfer medium and the density of the adjustment image are detected by the same detecting means.

According to a sixth aspect of the image forming apparatus of the present invention, there is provided the image forming apparatus of any one of the first through fifth aspects, wherein the first detecting means and the second detecting means are the same detecting means.

In the sixth aspect of the image adjustment method of the present invention and the sixth aspect of the image forming apparatus of the present invention, since the same detecting means is used as the first detecting means and the second detecting means, it is possible to easily detect the density of the adjustment image formed at a position where the surface condition of the transfer medium was detected and equalize the output characteristics related to the detection results, thereby enabling highly accurate density detection.

The above and further objects and features of the invention will more fully be apparent from the following detailed description with accompanying drawings.

DETAILED DESCRIPTION OF THE PREFERRED EMBODIMENT

The following description will explain an embodiment of the present invention, based on the drawings illustrating the embodiment.

Figure 1:
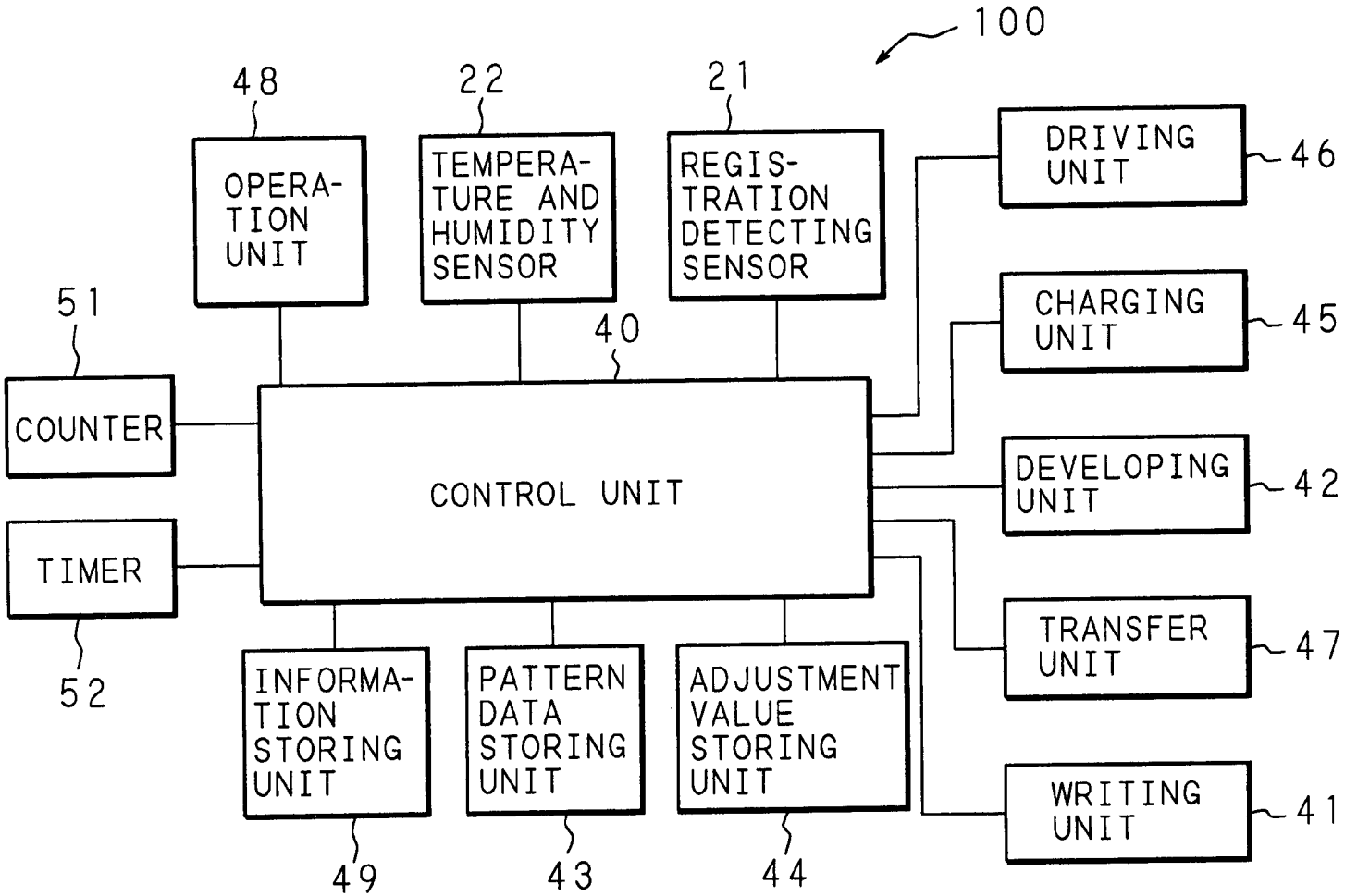
FIG. 1 is a block diagram showing a structure of an essential portion of an embodiment of an image forming apparatus of the present invention that executes an image adjustment method of the present invention.

FIG. 1 is a block diagram showing a structure of an essential portion of an embodiment of an image forming apparatus of the present invention for use in implementing an adjustment method of the present invention. This image forming apparatus 100 forms a multi-color image or monochrome image on a paper, according to image data inputted from outside. The image forming apparatus 100 comprises a driving unit 46 for driving a later-described photoconductor drum, a transfer drum, etc.; a charging unit 45 for charging the photoconductor drum to a predetermined potential; a writing unit 41 for forming an electrostatic latent image by scanning laser light on the charged photosensitive drum; and a developing unit 42 (image forming means) for developing the electrostatic latent image on the photoconductor drum with a developer.

This image forming apparatus 100 also comprises a transfer unit 47 (transferring means) for transferring and fixing the developed image on the photoconductor drum to a medium such as a paper (transfer medium); a pattern data storing unit 43 for storing pattern data of respective images for quality confirmation and color registration adjustment; an adjustment value storing unit 44 for storing an adjustment value for color registration adjustment; and an information storing unit 49 for storing various information for operations.

The image forming apparatus 100 also comprises a later-described registration detecting sensor 21; a temperature and humidity sensor 22 for detecting the temperature and humidity inside the image forming apparatus 100; an operation unit 48 including operation buttons and a display screen for operations; a counter 51 for performing counting necessary for operations; a timer 52 for measuring times necessary for operations; and a control unit 40 composed of a microcomputer which is connected to the above-mentioned respective units and controls the respective units.

Figure 2:
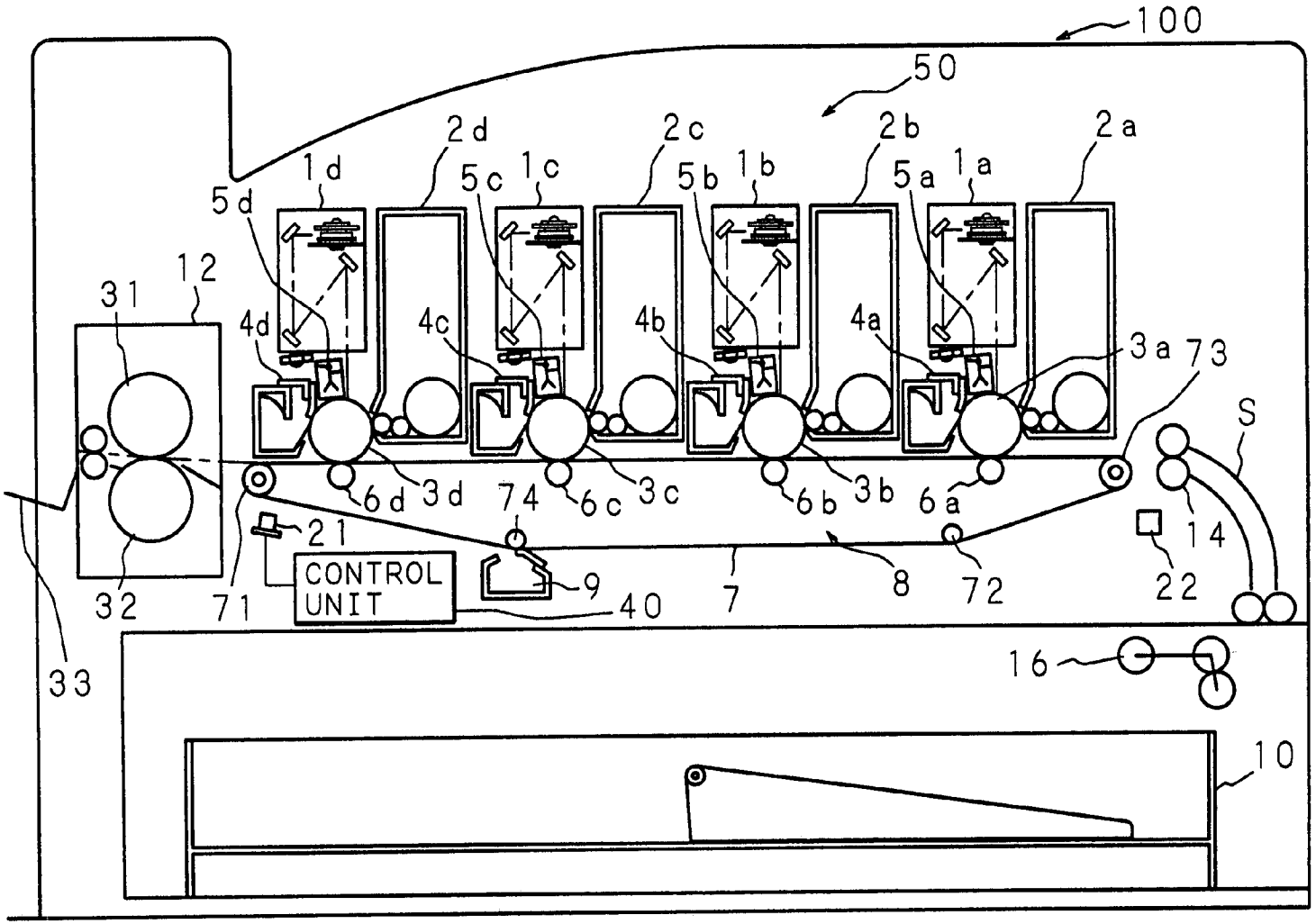
FIG. 2 is a schematic cross sectional view showing a vertical cross-section seen from the front side of the image forming apparatus.

FIG. 2 is a schematic cross sectional view showing a vertical cross-section seen from the front side of the image forming apparatus 100. This image forming apparatus 100 comprises a paper feed tray 10, a paper discharge tray 33, a fixing unit 12, an image forming unit 50, a transfer and transport belt unit 8, a registration detecting sensor 21 (detecting means), and a temperature and humidity sensor 22.

The paper feed tray 10 is a tray for storing papers for recording images, and is disposed in the lower stage of the image forming apparatus 100.

The paper discharge tray 33 is disposed on the left side in the middle stage of the image forming apparatus 100, and stores printed papers in face up condition.

The fixing unit 12 is disposed adjacent to the discharge tray 33 on the upstream side of a paper flow direction, and includes a heat roller 31 and a pressure roller 32. The temperature of the heat roller 31 is controlled to a predetermined temperature based on a detected value of a temperature detector (not shown). The heat roller 31 and the pressure roller 32 rotate while pinching a paper to which a toner image has been transferred between them, and fixes the toner image to the paper with heat and pressure by means of the heat of the heat roller 31.

The image forming unit 50 is disposed on the upstream side of the fixing unit 12 in the paper flow direction and in the middle stage of the image forming apparatus 100, and is composed of four image forming stations (image forming means) for respective colors, namely, black (K), cyan (C), magenta (M), and yellow (Y), arranged side by side along the paper flow direction. In order to form a multi-color image by using the respective black (K), cyan (C), magenta (M), and yellow (Y) colors, the four image forming stations comprise four exposure units 1*a*, 1*b*, 1*c*, 1*d*; developing devices 2*a*, 2*b*, 2*c*, 2*d*; photoconductor drums 3*a*, 3*b*, 3*c*, 3*d*; cleaner units 4*a*, 4*b*, 4*c*, 4*d*; and charging devices 5*a*, 5*b*, 5*c*, 5*d*, respectively, to form four kinds of latent images corresponding to the respective colors. Note that the letters "a", "b", "c" and "d" are added to the reference numerals of these component members to correspond to black (K), cyan (C), magenta (M), and yellow (Y), respectively.

In the following description, the members provided for the respective colors are collectively referred to as the exposure unit 1, the developing device 2, the photoconductor drum 3, the cleaner unit 4, and the charging device 5, except for the case where a member corresponding to a specific color, among the four members provided for the respective colors, is specified.

The exposure unit 1 is a write head, such as EL (Electro Luminescence) or LED (Light Emitting Diode), composed of light emitting elements arranged in an array, or a laser scanning unit (LSU) comprising a laser irradiation unit and a reflective mirror, and constitutes the writing unit 41 (see FIG. 1). In the example shown in FIG. 2, the LSU is used. By exposing the surface of the photoconductor drum 3 according to the inputted image data, the exposure unit 1 forms an electrostatic latent image corresponding to the image data on the photoconductor drum 3.

The developing device 2 constitutes the developing unit 42 (see FIG. 1), and develops the electrostatic latent image formed on the photoconductor drum 3 into a visible image with toner of each color.

The photoconductor drum 3 is disposed at the center of the image forming apparatus 100, and forms an electrostatic latent image and a toner image corresponding to the inputted image data on the circumferential surface thereof.

After the electrostatic latent image formed on the circumferential surface of the photoconductor drum 3 has been developed into a visible image and transferred, the cleaner unit 4 removes and recovers the toner remaining on the circumferential surface of the photoconductor drum 3.

The charging device 5 constitutes the charging unit 45 (see FIG. 1), and uniformly charges the circumferential surface of the photoconductor drum 3 to a predetermined potential. As the charging device 5, in addition to a roller type charging device or a brush type charging device both which come into contact with the photoconductor drum 3, a charger type charging device which does not come into contact with the photoconductor drum 3 may be used. In the example shown in FIG. 2, the charger type charging device is used.

The transfer and transport belt unit 8 is disposed under the respective photoconductor drums 3, and includes a transfer belt 7 (transfer medium), a transfer belt driving roller 71 for supporting the transfer belt 7 with applying tension on the downstream side of the paper, a transfer belt tension roller 73 for supporting the transfer belt 7 with applying tension on the upstream side of the paper, transfer belt driven rollers 72 and 74 disposed in the middle portion of the transfer belt 7, transfer rollers 6 (6*a*, 6*b*, 6*c*, 6*d*) (transferring means) disposed in contact with the lower portions of the respective photoconductor drums 3, and a transfer belt cleaning unit 9 disposed under the transfer belt 7.

Hereinafter, the four transfer rollers 6*a*, 6*b*, 6*c*, 6*d* corresponding to the respective colors are collectively referred to as the transfer rollers 6.

The transfer belt driving roller 71, transfer belt tension roller 73, transfer rollers 6, and transfer belt driven rollers 72, 74 are the members for supporting the transfer belt 7 with applying tension and driving and rotating the transfer belt 7 in one direction.

The transfer rollers 6 constitute the transfer unit 47 (see FIG. 1), and are rotatably supported on the housing of the transfer and transport belt unit 8. The transfer roller 6 has a metal shaft with a diameter of 8 to 10 mm as a base, and a surface covered with a conductive elastic material such as EPDM (ethylene-propylene-diene copolymer) or urethane foam. By using the conductive elastic material, the transfer roller 6 can uniformly apply a high voltage of the polarity opposite to the charged polarity of the toner to the paper, and transfer the toner image formed on the circumferential surface of the photoconductor drum 3 to the transfer belt 7 (transfer medium), or a paper (transfer medium) which is transported while being attracted onto the transfer belt 7.

The transfer belt 7 constitutes the transfer unit 47 (see FIG. 1), is formed in an endless form using an about 100 $\mu$m thick film of polycarbonate, polyimide, polyamide, polyvinylidene fluoride, polytetrafluoroethylene polymer, or ethylene tetrafluoroethylene polymer, and stretched to pass between the photoconductor drums 3 and the transfer rollers 6. By successively transferring the toner images in the respective colors formed on the photoconductor drums 3 to the transfer belt 7, or the paper which is transported while being attracted onto the transfer belt 7, a multi-color toner image is formed.

The transfer belt cleaning unit 9 removes and recovers toner for color registration adjustment which is directly transferred onto the transfer belt 7, toner for process control on the transfer belt 7, and toner which adheres to the transfer belt 7 due to contact with the photoconductor drums 3.

In order to detect the respective patch images for color registration adjustment formed on the transfer belt 7, the registration detecting sensor 21 (detecting means) is disposed at a position located after the passage of the transfer belt 7 through the respective image forming stations but before the transfer cleaning unit 9. This registration detecting sensor 21 supplies the detected values to the control unit 40 for detecting the densities of the patch images formed on the transfer belt 7 in the respective image forming stations, and for the purpose of detecting the density of the surface of the transfer belt 7 before the patch images were formed.

The temperature and humidity sensor 22 detects the temperature and humidity inside the image forming apparatus 100, and is disposed in the vicinity of a processing unit where there is no abrupt change in temperature and humidity.

In the image forming station of the image forming apparatus 100 having such structures, the exposure unit 1 forms an electrostatic latent image on the photoconductor drum 3 by performing exposure at a predetermined timing according to the inputted image data. Next, the developing unit 2 develops the electrostatic latent image into a visible form to form a toner image, and then the toner image is transferred to the transfer belt 7, or a paper which is transported while being attracted onto the transfer belt 7.

Since the transfer belt 7 is driven and rotated by the transfer belt driving roller 71, transfer belt tension roller 73, transfer belt driven rollers 72, 74, and transfer rollers 6, the respective color component toner images are successively transferred one upon another onto the transfer belt 7 or a paper which is transported while being attracted onto the transfer belt 7, so that a multi-color toner image is formed. In the case where the multi-color toner image is formed on the transfer belt 7, this multi-color toner image is further transferred onto a paper.

When performing color registration adjustment in the image forming apparatus 100 of this embodiment, the respective color component toner images formed at the respective image forming stations are transferred onto the transfer belt 7. At this time, a toner image to be the reference (hereinafter referred to as the reference patch image), among the respective color component toner images, is transferred onto the transfer belt 7, and then other color component toner image subjected to color misregistration adjustment (hereinafter referred to as the adjustment patch image) is transferred onto the reference patch image.

Figure 3:
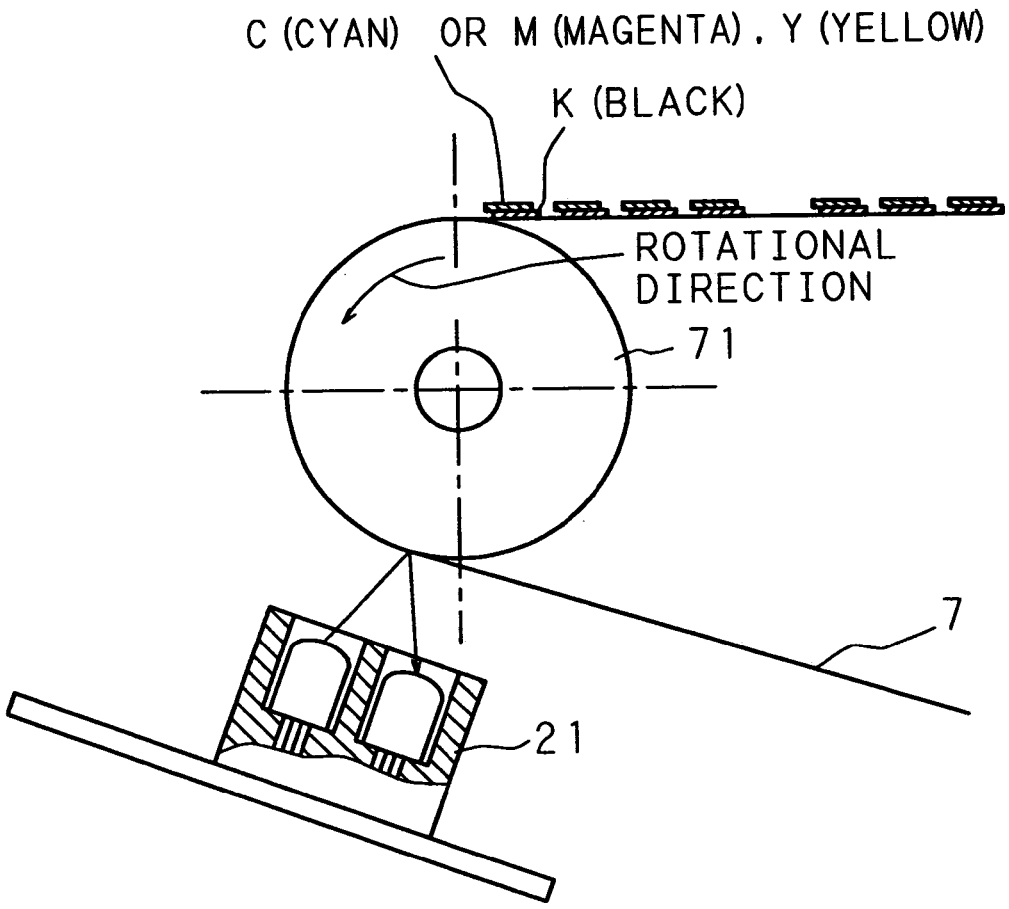
FIG. 3 is an explanatory view showing an example of the positional relationship between a registration detecting sensor and a transfer belt.

FIG. 3 is an explanatory view showing an example of the positional relationship between the registration detecting sensor and the transfer belt.

The transfer belt 7 is driven and rotated by the transfer belt driving roller 71. As shown in FIG. 3, when the reference patch image K (black) and the adjustment patch image C (cyan) which are formed on the transfer belt 7 reach the position of the registration detecting sensor 21, the registration detecting sensor 21 detects the density of the reference patch image and adjustment patch image on the transfer belt 7.

The registration detecting sensor 21 irradiates light on the transfer belt 7 and detects reflected light from the transfer belt 7, and thereby detects the density of the reference patch image and adjustment patch image. Then, based on the detection result, the exposure timing of the exposure unit 1 is adjusted, and the writing timing onto the photoconductor drum 3 is also adjusted. Such adjustment is similarly performed for colors to be adjusted, such as M (magenta) and Y (yellow), other than the above-mentioned C (cyan).

In this embodiment, although the reference patch image is K (black), it may be in any one of the colors (C, M, and Y). When the reference patch image is in a color other than K (black), the K (black) will be a color to be adjusted.

Moreover, as shown in FIG. 3, although the registration detecting sensor 21 is positioned so that the direction connecting the emission position of irradiated light and the detection position of reflected light is parallel to the conveying direction of the transfer belt 7, the registration detecting sensor 21 is not limited to this and may be positioned so that the direction of the same crosses or is orthogonal to, the conveying direction of the transfer belt 7.

Further, in this embodiment, the processing speed of image forming is set at 100 mm/sec, and a sampling cycle of the registration detecting sensor 21 is set at 2 msec.

Next, the following description will explain the operations of the image forming apparatus 100 according to the present invention.

In the image forming apparatus 100, when image data is inputted, the exposure unit 1 exposes the surface of the photoconductor drum 3 according to the inputted image data, and based on an adjustment value obtained by the color registration adjustment, thereby forming an electrostatic latent image on the photoconductor drum 3. The developing device 2 develops this electrostatic latent image into a toner image.

Meanwhile, one sheet of the papers stored in the paper feed tray 10 is separated by a pickup roller 16 and transported to a paper transport path S, and temporarily held by resist rollers 14. Based on a detection signal of a pre-resist detection switch (not shown), the resist rollers 14 transport the paper to the transfer belt 7 in accordance with the rotation of the photoconductor drum 3 at a timing controlled so that the leading end of the toner image on the photoconductor drum 3 coincides with the leading end of the image forming region of the paper. The paper is transported while being attracted onto the transfer belt 7.

The transfer of a toner image from the photoconductor drum 3 to a paper is carried out by the transfer roller 6 which is disposed to face the photoconductor drum 3 with the transfer belt 7 between them. A high voltage having the polarity opposite to the toner is applied to the transfer roller 6, thereby transferring the toner image to the paper. Four kinds of toner images corresponding to the respective colors are successively superposed on the paper transported by the transfer belt 7.

Thereafter, the paper is transported to the fixing unit 12, and the toner images are fixed on the paper with heat and pressure. The paper with the toner images fixed thereon is transported to the paper discharge tray 33.

When the transfer of the toner images to the paper has been finished, the cleaner unit 4 performs recovering/removing the toner remaining on the photoconductor drum 3. Finally, the transfer belt cleaning unit 9 performs recovering/removing the toner adhering to the transfer belt 7, so that a sequence of image forming operations is finished.

This embodiment illustrates a direct transfer type image forming apparatus as an example, in which a paper is carried on the transfer belt 7, and the toner images formed on the respective photoconductor drums 3 are superposed one upon another on the paper. However, the present invention is also applicable to an intermediate transfer type image forming apparatus in which the toner images formed on the respective photoconductor drums are transferred one upon another onto the transfer belt, and then collectively re-transferred to the paper to form a multi-color image, and, needless to say, the same effects as this embodiment can be obtained.

Next, the following description will explain in detail the color registration adjustment for the image forming apparatus 100 of the present invention. The color registration adjustment for the image forming apparatus 100 consists of the first through third color registration adjustments.

Here, an explanation is given for the case where the K (black) toner image and the C (cyan) toner image are used as a reference patch image and an adjustment patch image, respectively, and the color registration adjustment range covers 99 dots (lines) in the conveying direction of the transfer belt 7 (suppose that the start position is 0 dot and the end position is 99 dot).

Note that since the colors of toner images to be used as the reference patch image and the adjustment patch image are not particularly limited, any colors may be used. Moreover, the color registration adjustment range is not limited to the adjustment range of 99 dots, and may be set to a narrower range or a wider range. Further, the adjustment range may be changed according to conditions. In any case, when the adjustment range is wide, it takes a long time for the registration adjustment, whereas, when the adjustment range is narrow, it takes a short time for the registration adjustment.

[First Color Registration Adjustment]

The color registration adjustment performed by the image forming apparatus 100 is carried out by forming, on the transfer belt 7, reference patch images and adjustment patch images composed of a plurality of lines extending in a substantially orthogonal direction (hereinafter referred to as the main scanning direction) to a conveying direction (hereinafter referred to as the sub-scanning direction) of the transfer belt 7.

Figure 4:
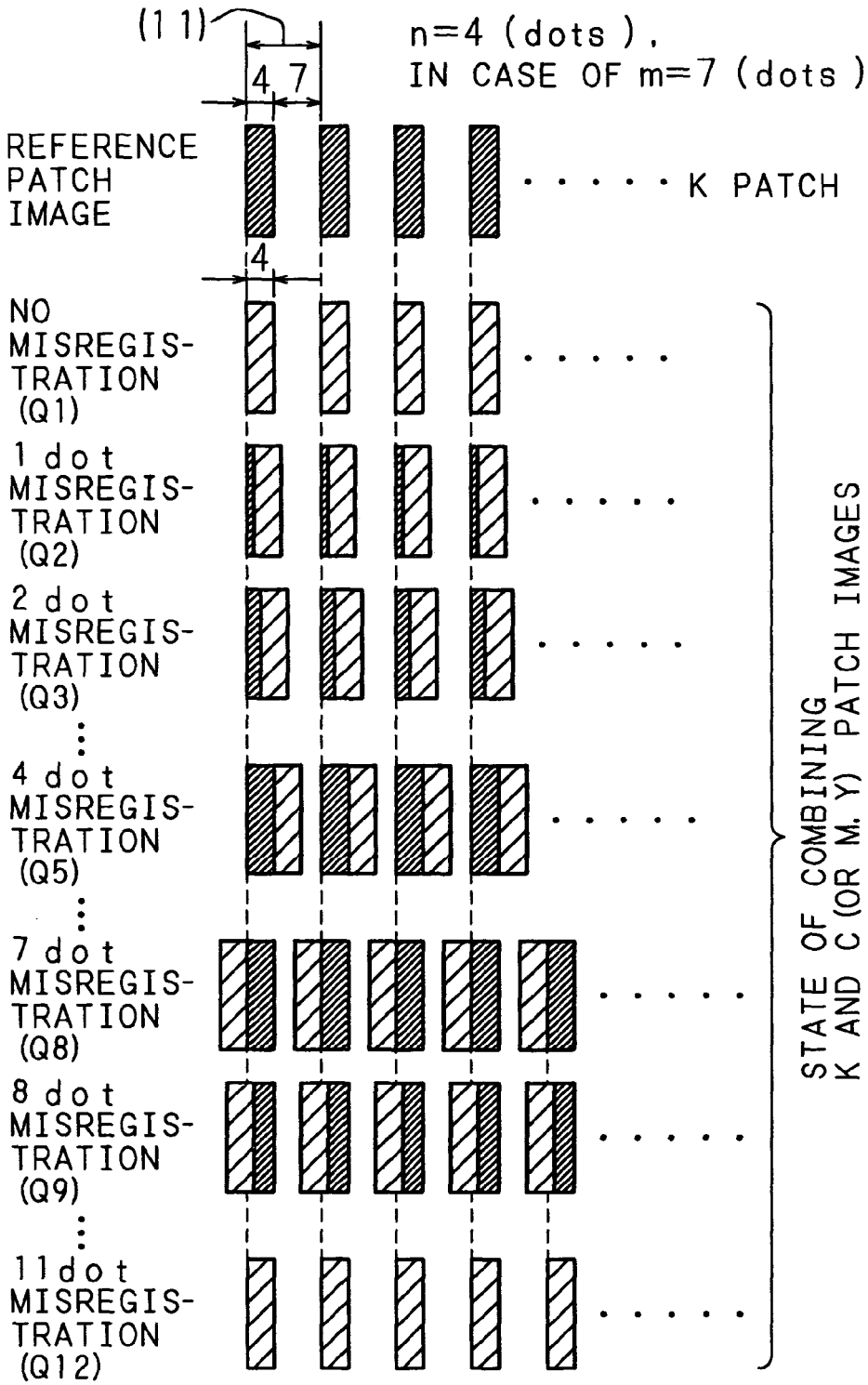
FIG. 4 is an explanatory view showing an example of reference patch images (reference lines) and adjustment patch images (adjustment lines)

In the first color registration adjustment, first, as shown in FIG. 4, for example, the pitch (m+n) (the second interval) of an image forming pattern is set to a total of 11 dots including a line width n of 4 dots and a line spacing m of 7 dots between lines, for example, and the reference patch images (hereinafter referred to as the reference lines) are formed on the transfer belt 7 (the K patch in FIG. 4). After forming the reference lines, an adjustment patch image (hereinafter referred to as the adjustment line) having the same line width n and line spacing m as the reference line is formed on each of the reference lines.

Figure 5:
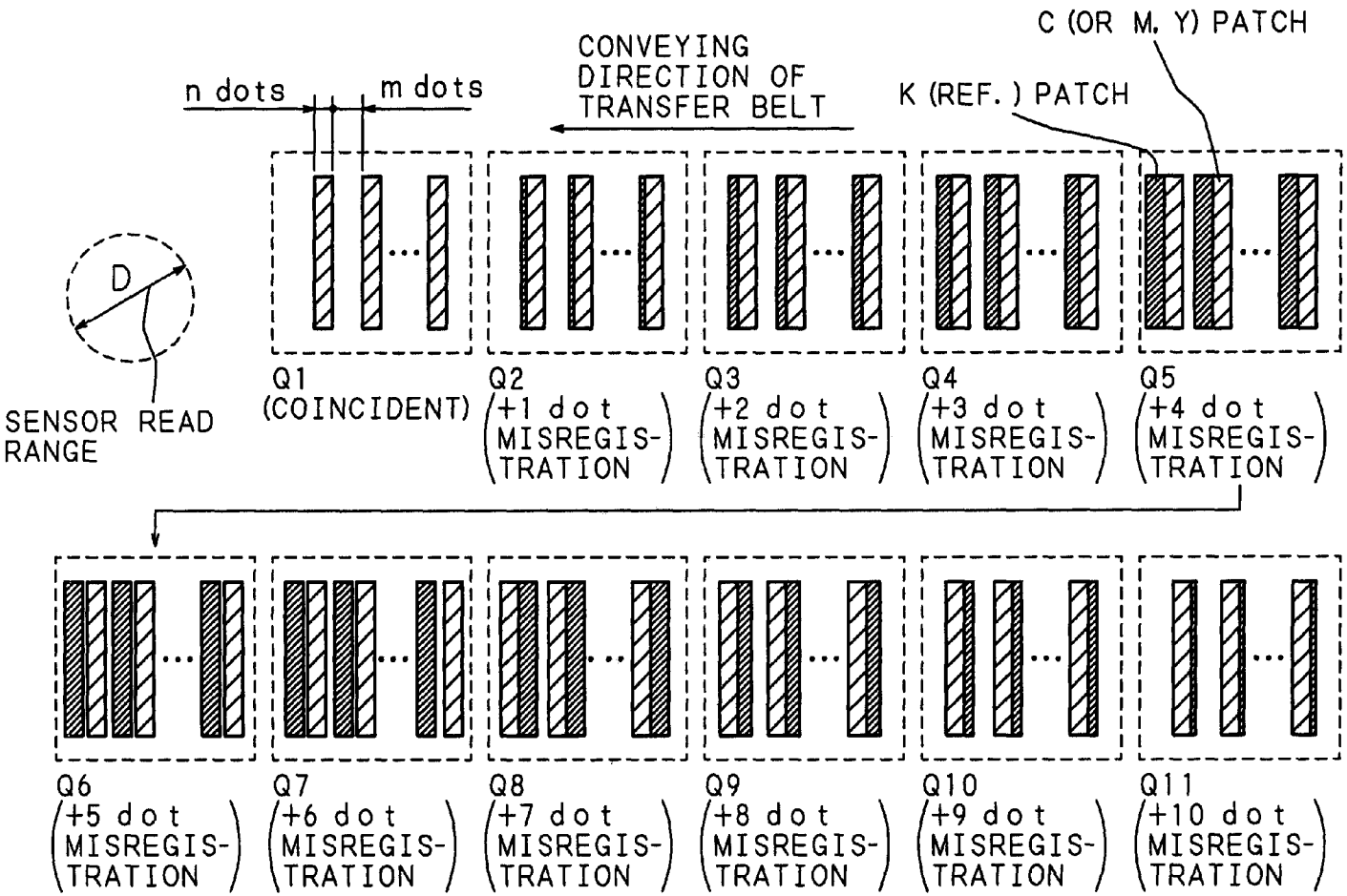
FIG. 5 is an explanatory view showing an example of the reference lines and the adjustment lines formed on the transfer belt in the first color registration adjustment in sub-scanning direction.

Subsequently, the density of the reference lines and the density of the adjustment lines formed on the transfer belt 7 are detected by the registration detecting sensor 21. As shown in FIG. 5 (an explanatory view showing an example of the reference lines and adjustment lines formed on the transfer belt 7), the registration detecting sensor 21 detects the density of the reference lines and the density of the adjustment lines within a sensor read range D.

The sensor read range D has a relatively larger diameter of about 10 mm, so that detection errors due to misregistration caused by small (minute) vibrations, etc can be averaged. The reference patch images and the adjustment patch images form a set image (the portion enclosed by the dotted line in FIG. 5 and later-described FIG. 9). Several tens to several hundreds of set images are formed per condition, and plural sets of set images are formed according to different conditions.

The density of the reference lines and the density of the adjustment lines on the transfer belt 7 varies depending on a superposed state of the reference line and adjustment line on the transfer belt 7. Specifically, according to the degree of overlapping of the reference line and the adjustment line, the detected value of reflected light detected by the registration detecting sensor 21 changes.

In other words, the density detection result of the registration detecting sensor 21 changes according to a total area of the area of only the reference lines, the area of only the adjustment lines, and the overlapping area of the reference lines and adjustment lines, within the area of the reference lines and adjustment lines formed on the surface of the transfer belt 7. In the case of a minimum area, i.e., when the reference lines and the adjustment lines perfectly overlap, the quantity of light absorbed by the reference lines and adjustment lines, in the light emitted by the registration detecting sensor 21, decreases and the reflected light from the transfer belt 7 is a maximum, and therefore the detected value (detection output) becomes higher.

In the case where a transparent transfer belt is used, similar detection can be performed by using a transmission type registration detecting sensor instead of the reflection type registration detecting sensor 21.

As described above, when the reference lines and the adjustment lines perfectly overlap, the detected value has an extreme value. In other words, by performing image forming in a condition under which the detected value becomes a maximum (or a minimum in the case of using a transparent transfer belt), it is possible to obtain a state in which the reference lines and the adjustment lines perfectly overlap.

In this first color registration adjustment, by noticing the fact that the detected value of the registration detecting sensor 21 has an extreme value when the reference lines and the adjustment lines perfectly overlap, the extreme value (maximum value) of the detected value of the registration detecting sensor 21 is obtained, and thereby performing the color registration adjustment. However, it may be possible to use a method that detects a state in which the reference lines and the adjustment lines are completely shifted from each other, i.e., detects a minimum value of the detected value of the registration detecting sensor 21.

In this embodiment, since the non-transparent black transfer belt 7 is used, when the reference lines and the adjustment lines perfectly overlap, the detected value of the registration detecting sensor 21 has the maximum extreme value. Therefore, the superposed state of the reference line and the adjustment line is changed by shifting the adjustment lines to be formed on the reference lines at an arbitrary rate, and then the detected values of the registration detecting sensor 21 for the respective states are inputted to obtain a maximum detected value.

More specifically, as described above, in the case where the reference lines and the adjustment lines are a plurality of lines with a line width n of 4 dots and a line spacing m of 7 dots between lines, when the reference lines and the adjustment lines perfectly overlap, the reference lines are perfectly covered with the adjustment lines as shown by Q1 in FIG. 5. That is to say, the registration detecting sensor 21 detects the density of an image composed of repetitions of a 4-dot line width where the 4-dot width of the reference line and the 4-dot width of the adjustment line perfectly overlap, and a 7-dot line spacing that is the original line spacing.

Next, when each adjustment line is shifted from the reference line forming position in the sub-scanning direction (the moving direction of the transfer belt) by 1 dot (hereinafter referred to as "+1 dot misregistration"), as shown by Q2 in FIG. 5, a misregistration state in which the reference line is not perfectly covered with the adjustment line will result. In short, the registration detecting sensor 21 detects a total line width of 5 dots, including a line width of 3 dots where the reference line and the adjustment line overlap and a 1-dot width of misregistration of each of the reference line and adjustment line ($5=3+1\times2$), and a 6-dot width line spacing. In other words, the registration detecting sensor 21 detects the density of an image composed of repetitions of a total width of 11 dots, including the 5-dot width line composed of the reference line and the adjustment line, and the 6-dot width line spacing.

As shown in FIG. 4 and FIG. 5, when the adjustment line is shifted 1 dot by 1 dot in the sub-scanning direction from the Q1 state representing no misregistration, the overlap state of the reference line and adjustment line changes successively as shown by Q1 to Q12. Then, when the adjustment line is shifted by +11 dots from the Q1 state, the state in which the reference line and the adjustment line perfectly overlap is generated again as shown by Q12 in FIG. 4, and the total width of 11 dots, including the 4-dot width line where both the lines perfectly overlap and the 7-dot width line spacing, repeats.

In short, the 11-dot misregistration state of the adjustment line is equal to the state before shifting the adjustment line, and the same state repeats whenever the adjustment line is shifted by 11 dots.

Accordingly, the creation and detection of the reference lines and adjustment lines are finished within a range of from the −5 dots misregistration position to the +5 dots misregistration position based on a predetermined state. Specifically, 11 kinds of set image patterns are formed by the adjustment lines ranging from the −5 dots misregistration position to the +5 dots misregistration position (the adjustment values "45" to "55" with respect to the reference line) based on, for example, the center value (the value "50" when the color registration adjustment range is from "0" to "99") in a color registration adjustable range, and the densities of the patterns are detected to finish the operation.

Even when the adjustment line is further shifted, i.e., shifted 12 dots ("56"), 13 dots ("57"), . . . , the same results will repeat. In short, the first color registration adjustment is performed for 11 kinds of conditions (in a 11-dot adjustment range within the color registration adjustable range) so as to enable prediction of an adjustment value of the exposure timing at which a color component image to be the reference and other color component image to be adjusted are in perfect register.

Figures 8A, 8B, 8C:
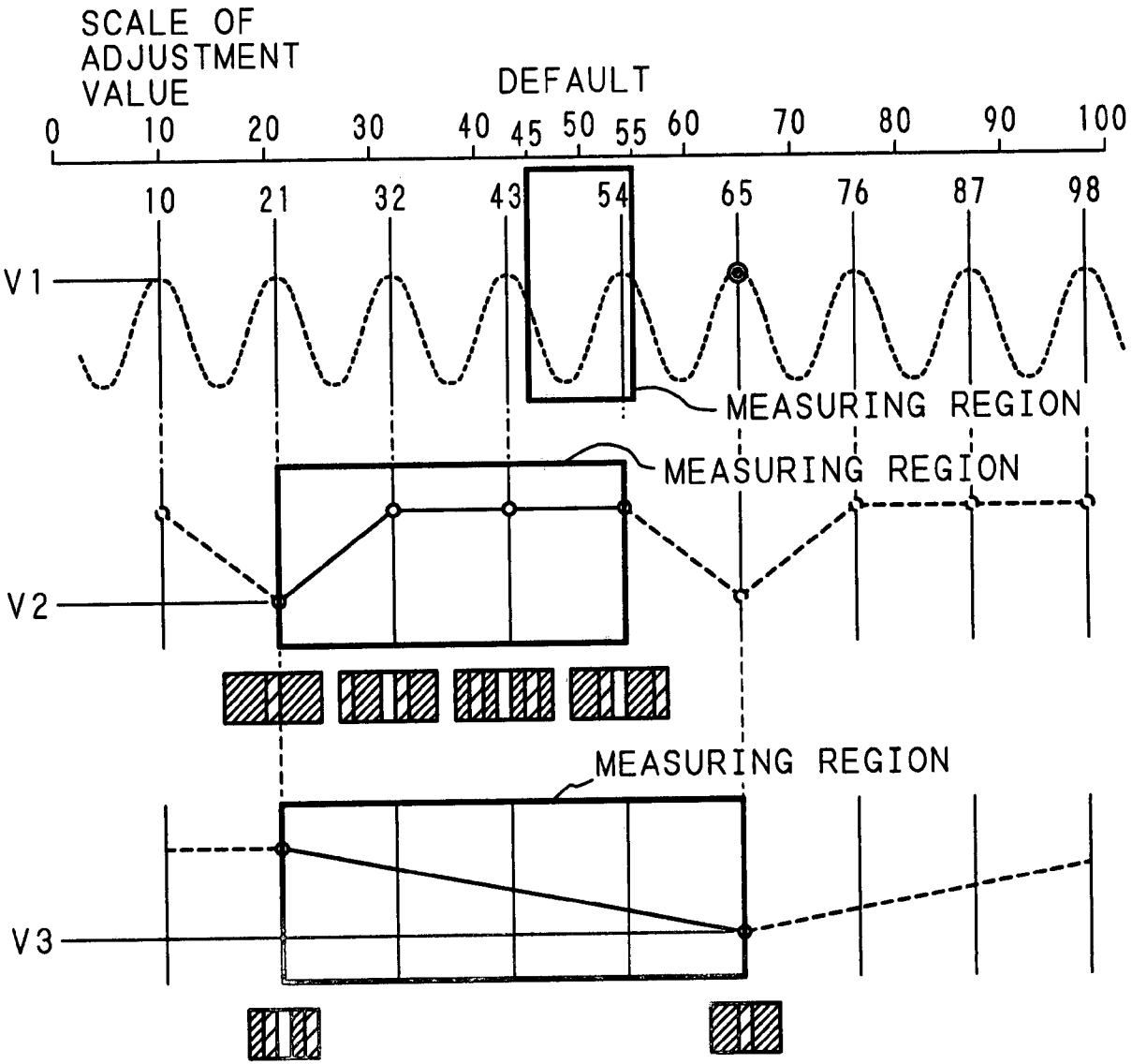
FIGS. 8A, 8B and 8C are explanatory views showing examples of detected values of the registration detecting sensor.

When changes in the superposed state of the reference line and adjustment line are detected within the sensor read range D (here, the diameter D=10 mm) of the registration detecting sensor 21 as described above and the detected values are shown in graph, as shown in FIG. 8A, the state in which the reference line and adjustment line perfectly overlap, i.e., a point where the detected value becomes a maximum (an adjustment value of "54" in this embodiment), is detected as the coincident point by output V1.

However, there is a possibility that this coincident point is not a true coincident point, and any one of other misregistrations of +11 dots (adjustment value "65"), +22 dots (adjustment value "76"), +33 dots (adjustment value "87"), +44 dots (adjustment value "98"), −11 dots (adjustment value "43"), −22 dots (adjustment value "32"), −33 dots (adjustment value "21"), and −44 dots (adjustment value "10") with respect to the adjusting value "54" is the true coincident state.

In short, any one of these nine points is the true coincident point, and, in this stage, it is only possible to predict candidates of the true coincident point. Therefore, even when the exposure timing of the exposure unit 1 for forming the adjustment line is adjusted using the adjustment value at which the detected value of the registration detecting sensor 21 is a maximum, the reference color component image and the other color component image to be adjusted may be or may not be superposed perfectly.

[Second Color Registration Adjustment]

Therefore, in order to obtain the true coincident point of a color component image to be the reference and other color component image to be adjusted, i.e., an adjustment value to be the true coincident point, from the adjustment value ("54") obtained in the first color registration adjustment and predicted values that can be obtained from this adjustment value, the second color registration adjustment is performed to narrow the candidates of the true coincident point for the first time. In this second color registration adjustment, based on the obtained adjustment value "54", the candidates of the true coincident point is narrowed from four predicted values including the obtained adjustment value "54" (for example, "21", "32", "43" and "54").

Here, the four predicted values are not limited to the numbers mentioned above, and may be any four successive predicted values.

In the second color registration adjustment, based on the timing corresponding to the maximum adjustment value obtained in the first color registration adjustment, writing onto the photoconductor drum 3 is performed by the exposure of the exposure unit 1, and the reference patch images and the adjustment patch images are formed on the transfer belt 7.

Figure 6:
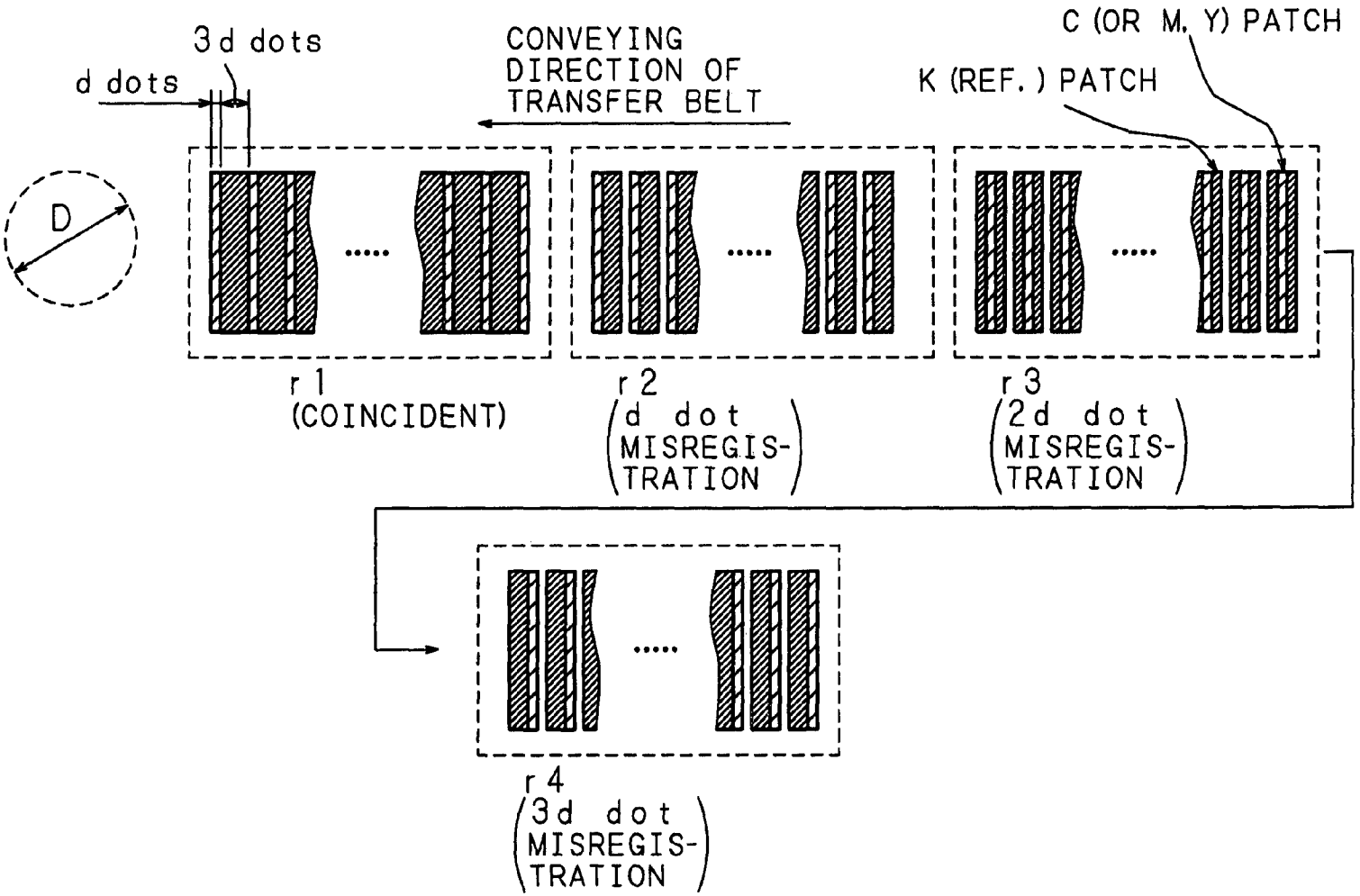
FIG. 6 is an explanatory view showing an example of the reference lines and the adjustment lines formed on the transfer belt in the second color registration adjustment in sub-scanning direction.

At this time, the reference patch image and adjustment patch image to be formed use the number d of dots (d=m+n) per pitch of the reference line and adjustment line of the first color registration adjustment as the reference, and, as shown in FIG. 6, the line width of the reference patch image is set to a number of dots three times greater than d, and the line spacing (the width where no line is formed) of the reference patch image is set to d. Besides, the line width of the adjustment patch image is set to d, and the line spacing (the width where no line is formed) of the adjustment patch image is set to a number of dots three times greater than d, and the pattern forming pitch of each of the reference line and adjustment line is set to 4d dots (44 dots).

In the second color registration adjustment, similarly to the first color registration adjustment, the adjustment patch images are formed while shifting them with respect to the reference patch images by a number of dots related to the pitch of the patch image of the first color registration adjustment, and the detected values of the registration detecting sensor 21 are obtained. More specifically, as shown in FIG. 6, the adjustment lines are formed while shifting them d dots by d dots which are the width of the adjustment line.

In this second color registration adjustment, settings are made so that, when the position of a color component image to be the reference and the position of other color component image to be adjusted perfectly coincide with each other, the forming position of the reference patch image and that of the adjustment patch image are completely shifted from each other. Therefore, as shown in FIG. 8B, in the state in which an adjustment patch image is formed between reference patch images, i.e., the state in which the reference patch image and the adjustment patch image are continuous (the state without a gap in the sub-scanning direction on the transfer belt 7), the detection registration sensor 21 detects a minimum value (output V2, the adjustment value "21"), so that an adjustment value for the coincident point is obtained.

On the other hand, as shown in FIG. 8B, when the adjustment patch image is formed over the reference patch image, the output value increases. In this case, the adjustment value indicates a state in which the position of the color component image to be the reference and that of the other color component image to be adjusted are shifted from each other, and is not an adjustment value to be the true coincident point.

Here, since it can be predicted that the same state will be generated by a shift of 4d dots (44 dots) with respect to the obtained adjustment value "21", it is possible to narrow the candidates of the true coincident point to the adjustment values "21" and "65".

[Third Color Registration Adjustment]

Furthermore, in order to obtain which one of these two adjustment values is the true coincident point, the third color registration adjustment is performed.

In the third color registration adjustment, based on the adjustment value ("21") obtained in the second color registration adjustment, a determination is made on the two predicted values including "21" ("21" and "65").

In the third color registration adjustment, based on the timing corresponding to the maximum adjustment value obtained in the first color registration adjustment, writing onto the photoconductor drum 3 is performed by the exposure of the exposure unit 1, and the reference patch images and adjustment patch images are formed on the transfer belt 7.

Figure 7:
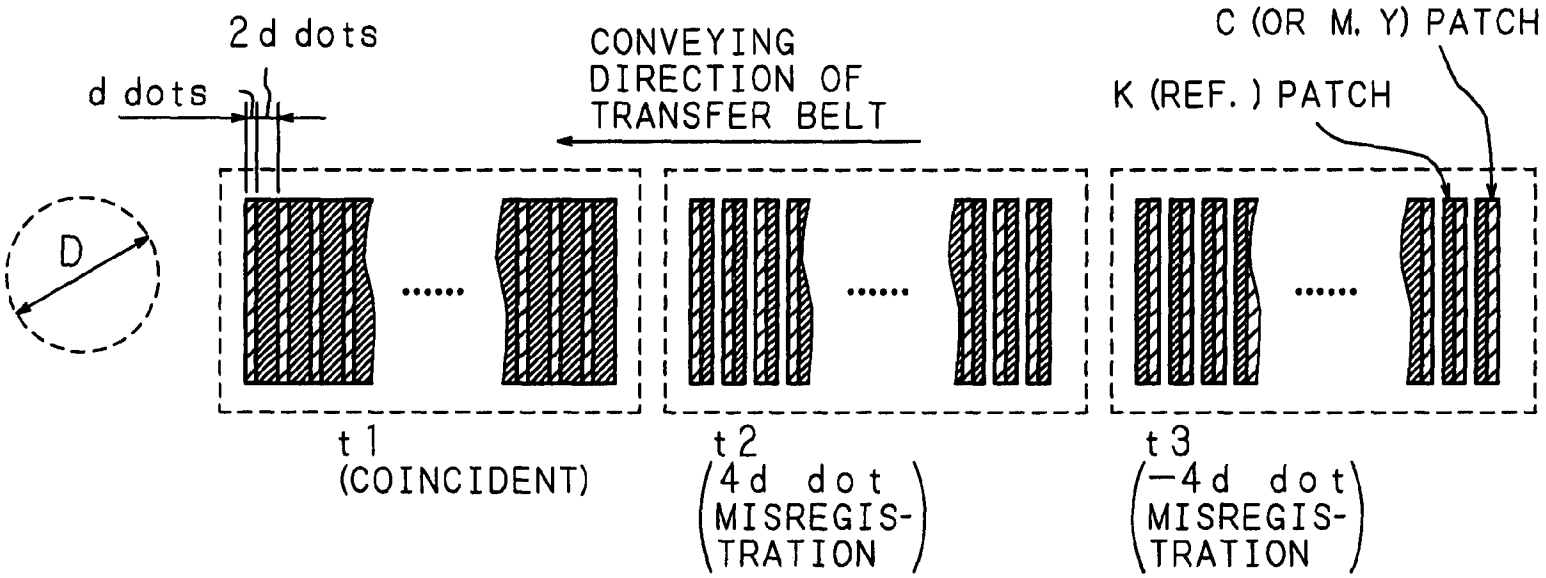
FIG. 7 is an explanatory view showing an example of the reference lines and the adjustment lines formed on the transfer belt in the third color registration adjustment in sub-scanning direction.

At this time, the reference patch image and adjustment patch image to be formed use the number d of dots (d=m+n) per pitch of the reference line and adjustment line of the first color registration adjustment as the reference, and, as shown in FIG. 7, the line width of the reference patch image is set to a number of dots (2d) twice greater than d, and the line spacing (the width where no line is formed) of the reference patch image is set to d. Besides, the line width of the adjustment patch image is set to d, and the line spacing (the width where no line is formed) of the adjustment patch image is set to a number of dots (2d) twice greater than d, and the pattern forming pitch of each of the reference line and the adjustment line is set to 3d dots (33 dots).

In the third color registration adjustment, similarly to the second color registration adjustment, the adjustment patch images are formed while shifting them with respect to the reference patch images by a number of dots related to the pitch of the patch image of the second color registration adjustment, and the detected values of the registration detecting sensor 21 are obtained. More specifically, as shown in FIG. 7, the adjustment lines are formed while shifting them 4d dots by 4d dots (44 dots) which are the line pitch in the second color registration adjustment.

In the third color registration adjustment, similarly to the second color registration adjustment, settings are made so that, when the position of a color component image to be the reference and the position of other color component image to be adjusted perfectly coincide with each other, the forming position of the reference patch image and that of the adjustment patch image are completely shifted from each other. Therefore, as shown in FIG. 8C, in the state in which an adjustment patch image is formed between reference patch images, i.e., the state in which the reference patch image and the adjustment patch image are continuous (the state without a gap in the sub-scanning direction on the transfer belt 7), the detection registration sensor 21 detects a minimum value (output V3, the adjustment value "65"), so that an adjustment value for the true coincident point is obtained.

On the other hand, as shown in FIG. 8C, when the adjustment patch image is formed over the reference patch image (the adjustment value "21"), the output value increases. In this case, the adjustment value indicates a state in which the position of the color component image to be the reference and that of the other color component image to be adjusted are shifted from each other, and is not an adjustment value to be the true coincident point.

As described above, by performing the color registration adjustment in three steps to predict adjustment values that may be the coincident point and to narrow the candidates of the coincident point, it is possible to efficiently and easily find an exposure timing of the exposure unit 1 for forming a color component image to be adjusted, which allows the reference color component image and the color component image to be adjusted to be perfectly coincide with each other, from a wide color registration adjustment range, and performs the adjustment.

In the above, the color registration adjustment performed when the adjustment direction of the reference patch images and adjustment patch images formed on the transfer belt 7 was the sub-scanning direction is explained. However, since it is certain that misregistration also exists in the main scanning direction, the color registration adjustment is performed by forming the reference patch images and the adjustment patch images in a direction perpendicular to the direction in the adjustment in sub-scanning direction.

Figure 9:
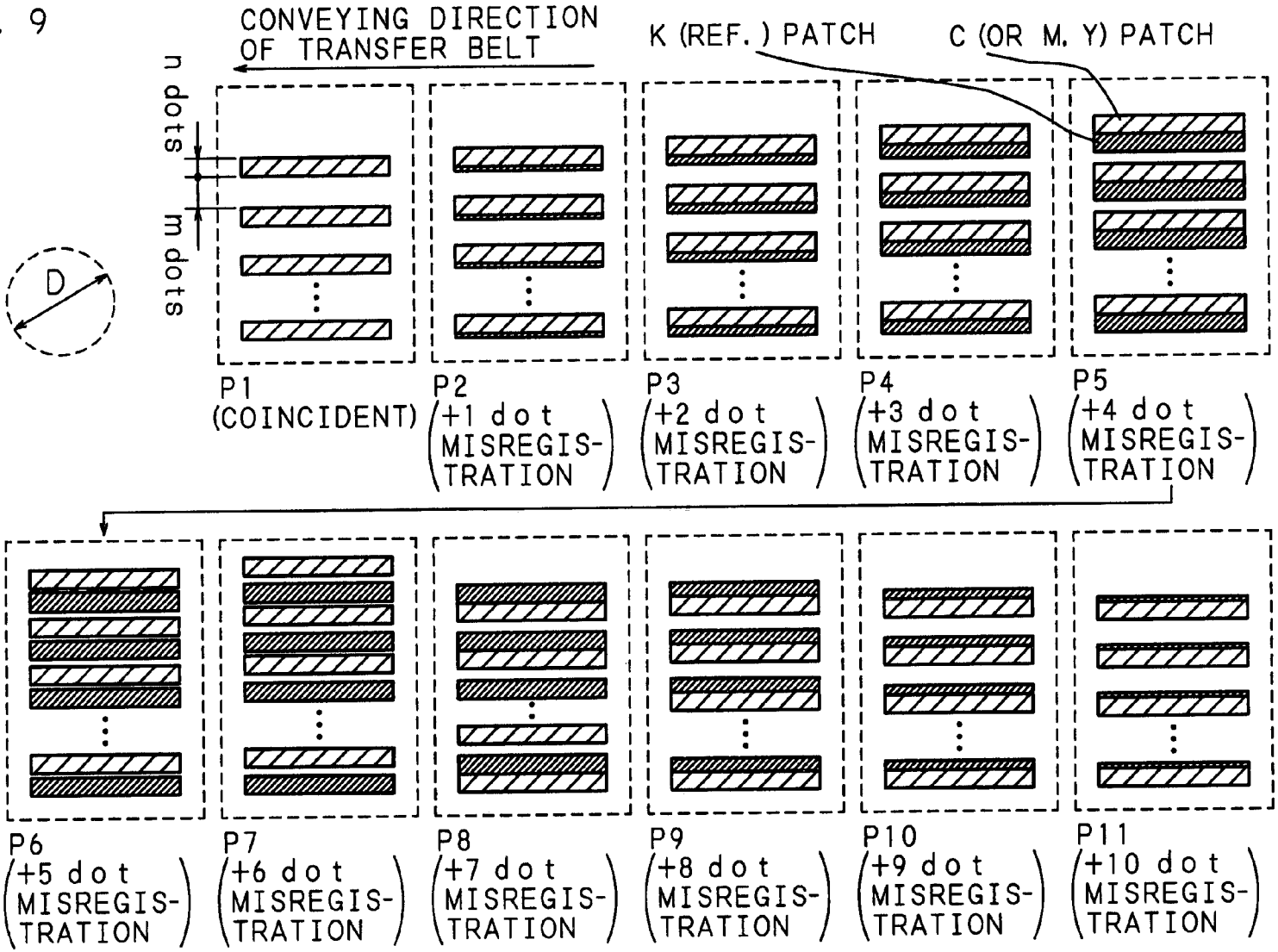
FIG. 9 is an explanatory view showing an example of the reference lines and the adjustment lines formed on the transfer belt in the first color registration adjustment in main-scanning direction.

In this case, with the use of an image forming pattern as shown in FIG. 9, first, as the first color registration adjustment, the adjustment lines are formed while gradually shifting them within a range of the pitch of the image forming pattern so as to find a state in which the reference patch images and the adjustment patch images perfectly overlap.

Figure 10:
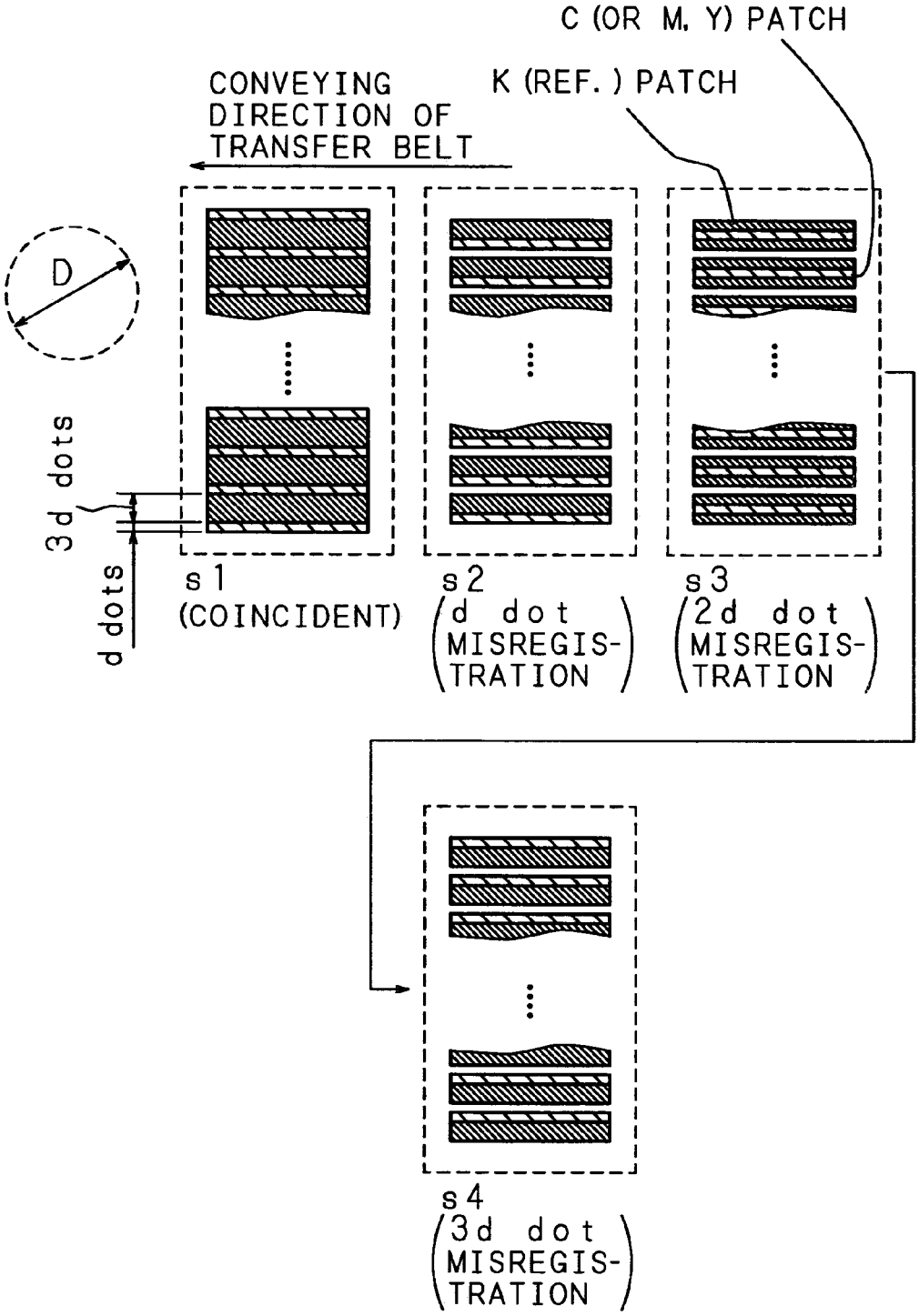
FIG. 10 is an explanatory view showing an example of the reference lines and the adjustment lines formed on the transfer belt in the second color registration adjustment in main-scanning direction.

Next, as the second color registration adjustment, with the use of an image forming pattern as shown in FIG. 10, the adjustment lines are formed while gradually shifting them by an amount corresponding to the pattern pitch in the first color registration adjustment so as to find a state in which the forming position of the reference patch image and that of the adjustment patch image do not overlap.

Figure 11:
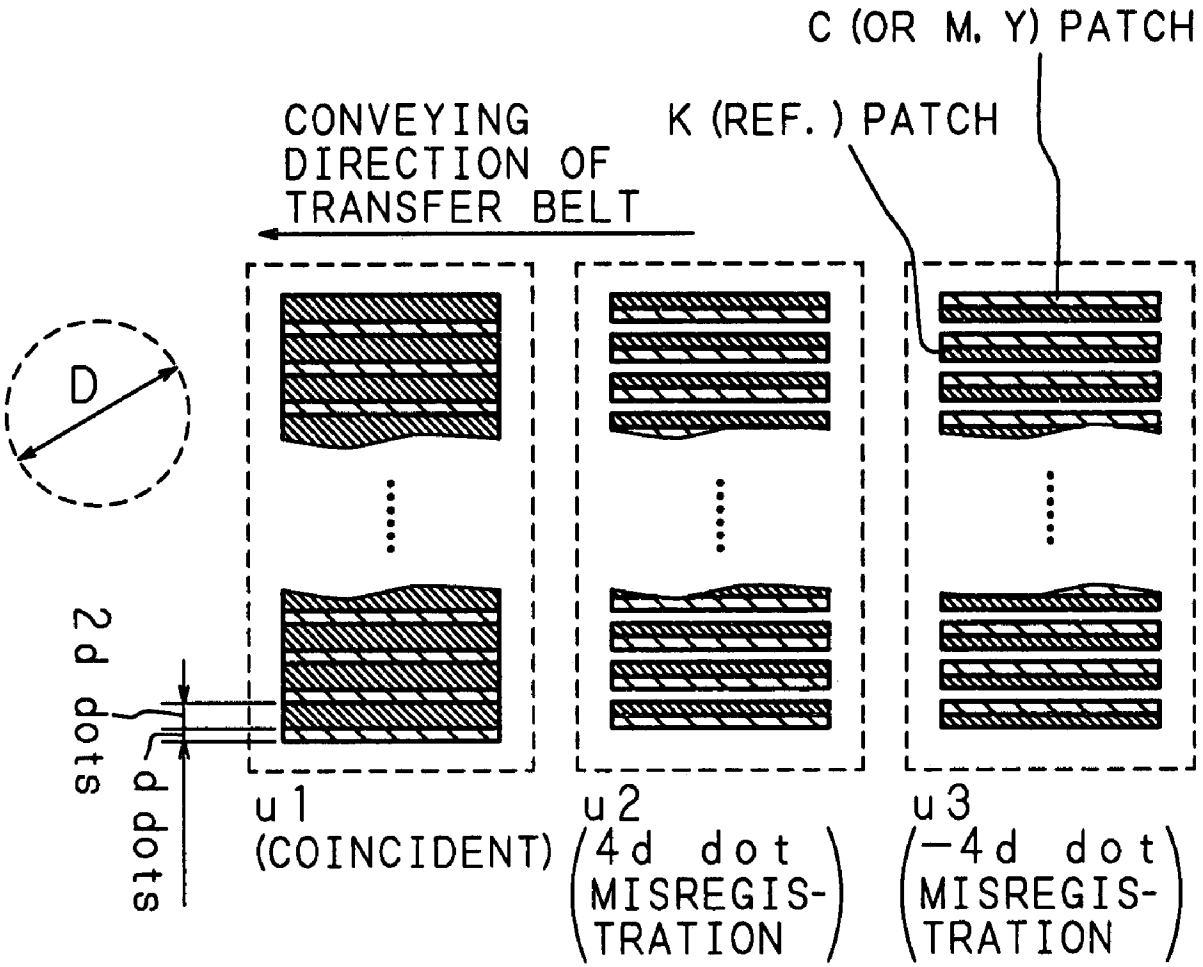
FIG. 11 is an explanatory view showing an example of the reference lines and the adjustment lines formed on the transfer belt in the third color registration adjustment in main-scanning direction.

Furthermore, as the third color registration adjustment, with the use of an image forming pattern as shown in FIG. 11, a color registration adjustment is performed by gradually shifting the adjustment lines by an amount corresponding to the pattern pitch in the second color registration adjustment so as to obtain an exposure timing at which the color component image to be the reference in the main scanning direction and the color component image to be adjusted perfectly coincide with each other and perform the adjustment.

Note that the color registration adjustment may be performed in either or both of the main scanning direction and the sub-scanning direction. Accordingly, it is possible to adjust both the misregistration in the sub-scanning direction and that in the main-scanning direction according to a need, and obtain excellent image quality.

The above explanation describes in detail the adjustment for one color component to be adjusted, but the same adjustment is also performed for other color component images to be adjusted. In this case, the color components to be adjusted may be adjusted on a one-by-one basis, or all the color components to be adjusted may be adjusted in parallel.

Figure 12:
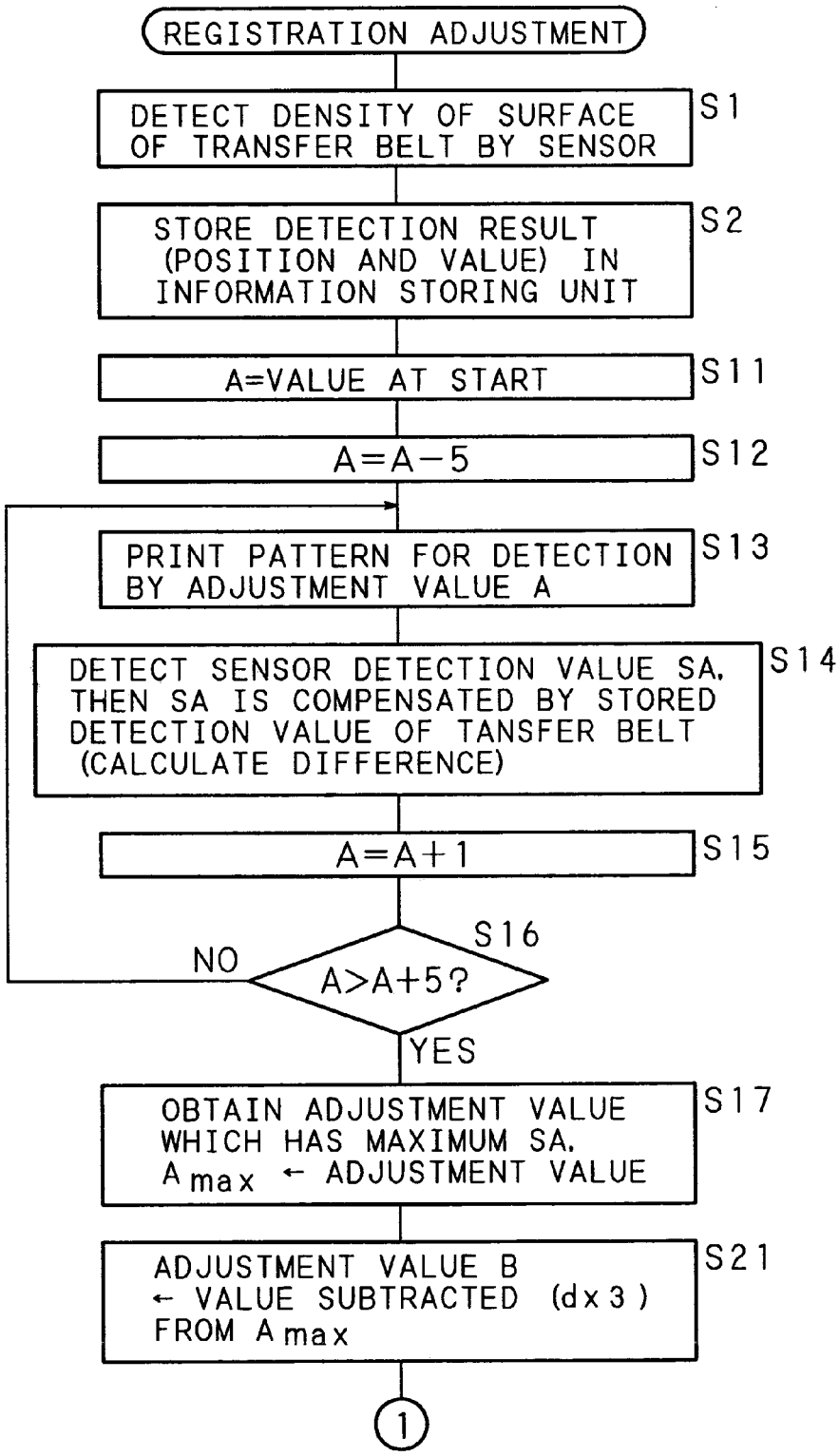
FIG. 12 is a flowchart showing the image adjustment method for an image forming apparatus of the present invention.
Figure 13:
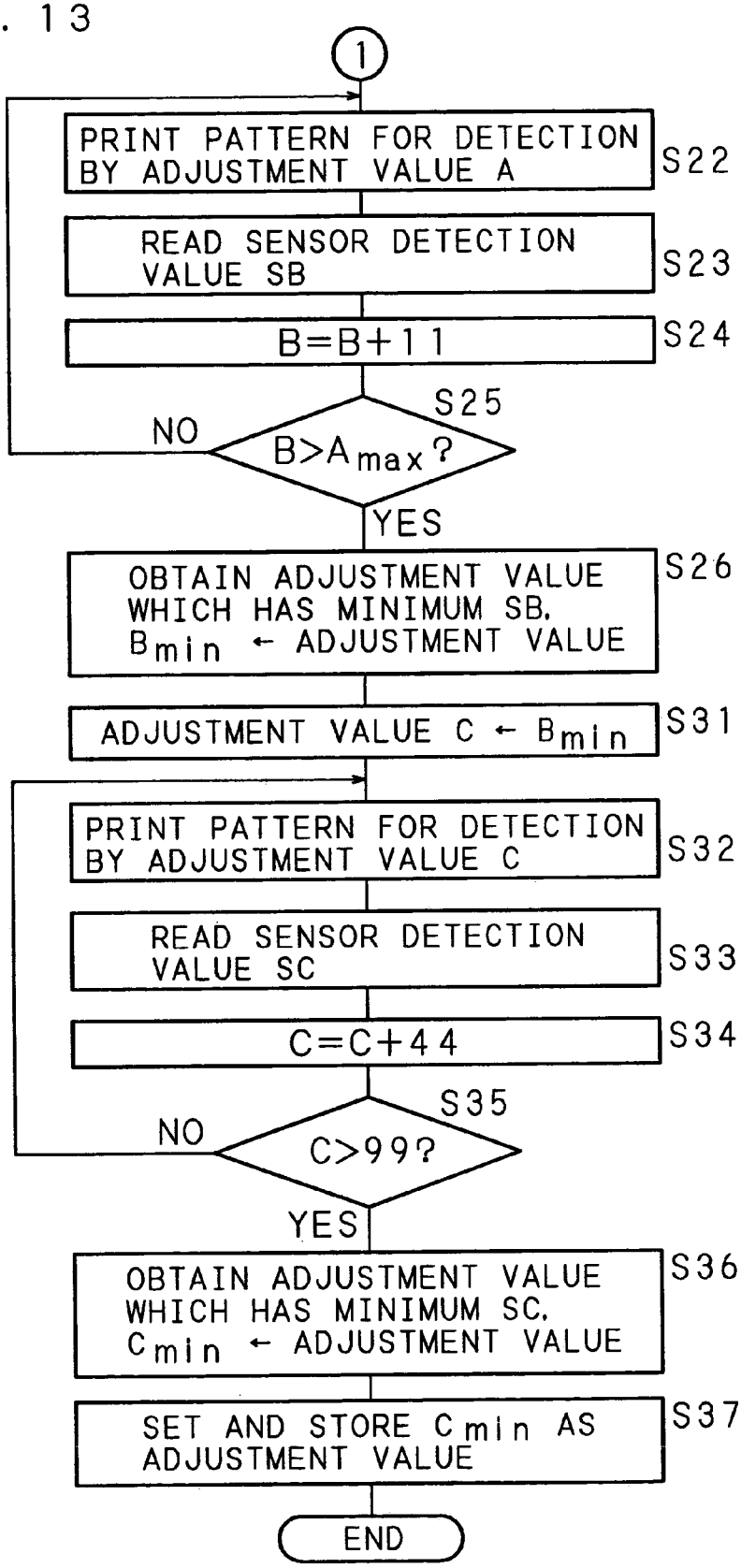
FIG. 13 is a flowchart showing the image adjustment method for an image forming apparatus of the present invention.

Next, the following description will explain an image adjustment method (color registration adjustment method) for the image forming apparatus 100 of the present invention with reference to the flowcharts of FIG. 12 and FIG. 13 illustrating the method.

First, the control unit 40 of the image forming apparatus 100 causes the registration detecting sensor 21 to detect the density of the surface of the transfer belt 7 (S1), and stores the detected position on the transfer belt 7 and the detected density of the surface in the information storing unit 49 (S2).

In the case where the registration detecting sensor 21 detects the specular reflected light, the intensity (light quantity) of the specular reflected light differs depending on the surface of the transfer belt 7 where no images are formed, the patch image (the reference patch image) of K toner, and the patch images (the adjustment patch images) of chromatic color toners (C, M, Y). There is a big difference in the specular reflected light between the K patch image and the chromatic color (C, M, Y) patch images, and the specular reflected light from the K patch image is weaker.

On the other hand, the specular reflected light from the surface of the transfer belt 7 where no images are formed is substantially equal to that from the chromatic color (C, M, Y) patch images, and the specular reflected light from the K patch image is weaker. By using these characteristics, the detection of registration is performed.

Figure 14A:
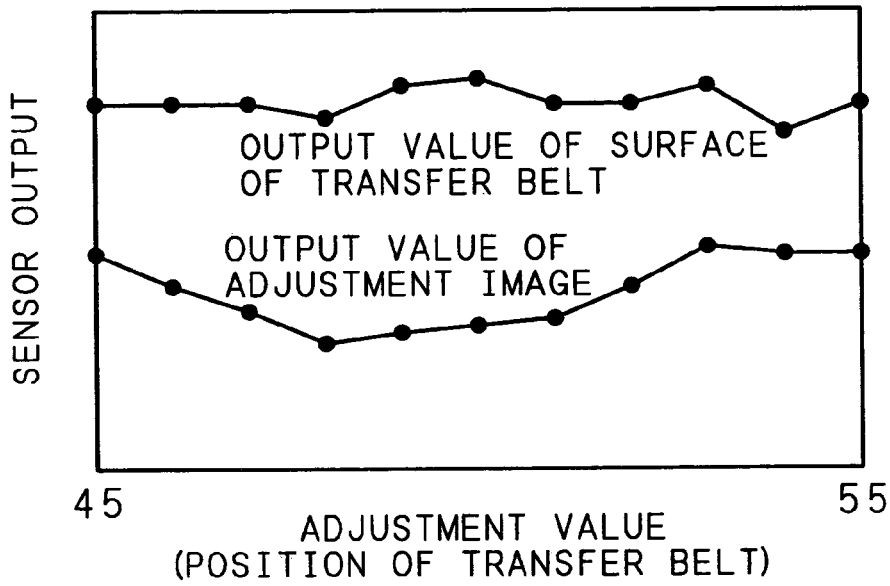
FIG. 14A and FIG. 14B are explanatory views showing examples of the density of the surface of the transfer belt, the density of an adjustment image, and the difference between them.
Figure 14B:
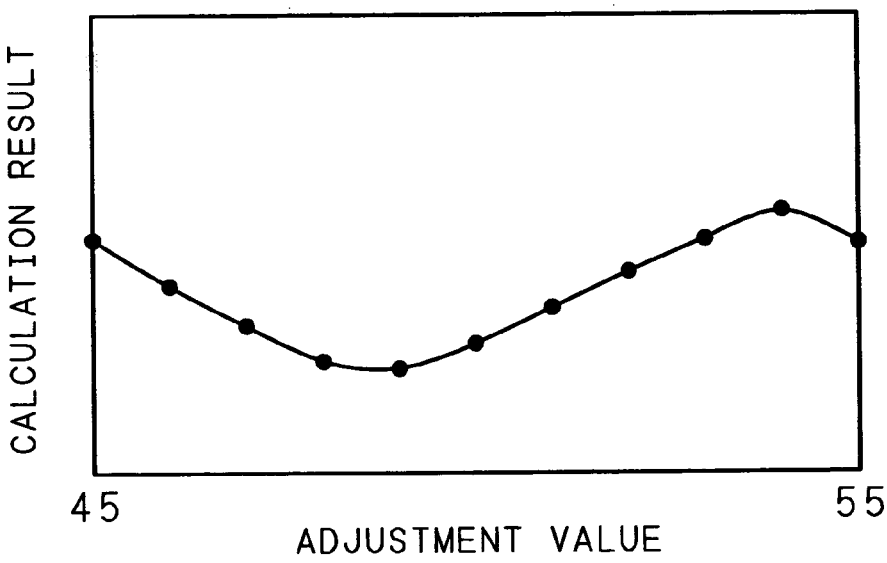

However, when detecting the density using the specular reflected light, as shown in FIG. 14A, the density of the surface of the transfer belt 7 varies depending on the surface condition of the transfer belt 7 (particularly, the presence or absence of scratches) and the position, and a value that is largely deviated from the actual value tends to be detected as the density of the adjustment image by the registration detecting sensor 21. Therefore, in some case, the above-mentioned maximum value and minimum value are detected erroneously. Hence, as shown in FIG. 14B, the difference between the density of the surface of the transfer belt 7 and the density of the adjustment image is obtained, and a maximum value or a minimum value of the values corrected by regarding the density of the surface of the transfer belt 7 (sensor output value) as a fixed value is detected.

In this embodiment, only in the first color registration adjustment, the difference from the detected data of the density of the surface of the transfer belt 7 is obtained and the coincident point (maximum value) is obtained. However, similarly, in the second and third color registration adjustments, it is possible to obtain the difference from the detected data of the density of the surface of the transfer belt 7 and obtain the coincident point (minimum value).

The method of detecting the density by specifying a position on the transfer belt 7 is carried out based on the rotation amount of a motor, not shown, that drives the transfer belt 7 (based on the number of steps when the motor is a stepping motor, and, for example, the actual number of steps with respect to the number of steps for one rotation of the transfer belt 7). Accordingly, a position can be specified extremely roughly compared to the position detection method in which an absolute position of the transfer belt 7 is detected, and therefore a mark for specifying a position is not formed on the transfer belt 7 in this embodiment. However, it may also be possible to use a method in which a mark is formed on the transfer belt 7, and a position is detected based on the mark.

As described above, the control unit 40 stores in the information storing unit 49 the detected data of the density at a position of the transfer belt 7 specified by the timing (S1) at which the registration detecting sensor 21 starts detecting the density of the surface of the transfer belt 7, and the number of steps of the stepping motor (S2).

Subsequently, the control unit 40 performs the above-explained color registration adjustment. Note that, in the color registration adjustment, similarly to the above explanation, the color registration adjustment range covers 99 dots, and the color registration adjustment range is a range from 0 dot to 99 dot. Moreover, patterns for detection for use in the first color registration adjustment are formed so that the pitch of the patch image is 11 dots, the line width of each of the reference patch image and the adjustment patch image is 4 dots, the line spacing (the width where no line is formed) is 7 dots, and the shift condition of the adjustment line is 1 dot.

Patterns 2 for detection for use in the second color registration adjustment are formed so that the pitch of the patch image is 44 dots, the line width of the reference patch image is 33 dots, the line spacing of the reference patch image is 11 dots, the line width of the adjustment patch image is 11 dots, the line spacing of the adjustment patch image is 33 dots, and the shift condition of the adjustment line is 11 dots.

Further, patterns for detection for use in the third color registration adjustment are formed so that the pitch of the patch image is 33 dots, the line width of the reference patch image is 22 dots, the line spacing of the reference patch image is 11 dots, the line width of the adjustment patch image is 11 dots, the line spacing of the adjustment patch image is 22 dots, and the shift condition of the adjustment line is 44 dots.

When executing the color registration adjustment, first, the control unit 40 defines an arbitrary position in the color registration adjustment range as an adjustment value A at start (S11).

In general, the adjustment value A is the center value of the color registration adjustment range, and, when the color registration adjustment range covers 99 dots, A=50 is set as the default value and stored in the adjustment value storing unit 44. Here, the adjustment value means an adjustment value for the exposure timing of the exposure unit 1 of the image forming station for forming the adjustment patch image.

Next, the control unit 40 sets an adjustment value obtained by subtracting 5 from the adjustment value A to be the adjustment value A (S12). Specifically, when the initial value of the adjustment value A is "50", the adjustment value A will be "45".

Then, the control unit 40 causes the image forming unit 50 to form (print) the patterns for detection for use in the first color registration adjustment (S13).

Here, while the reference patch image of the pattern for detection is formed according to a predetermined timing, the adjustment patch image is formed according to the adjustment value A, namely, the adjustment value "45" of the exposure timing. Specifically, the adjustment patch image (adjustment line) is formed according to the timing of −5 dots shifted position with respect to the forming position of the adjustment patch image according to the default adjustment value. However, the initial value is not limited to "45", and may be set to any value (0 to 88) excluding values larger than "88" (99−11=88), according to a condition.

Next, the control unit 40 causes the registration detecting sensor 21 to detect the density of the reference patch images and the density of the adjustment patch images on the transfer belt 7, subtracts the density of the surface of the transfer belt 7 stored in the information storing unit 49 from the detected value SA to obtain the absolute value of the result, and thereby corrects the detected value SA (S14).

Then, the control unit 40 sets a value obtained by adding 1 to the adjustment value A to be the adjustment value A (S15), determines whether or not the adjustment value A exceeds (A+5), namely "55" (S16). When the result is NO (NO in step S16), the control unit 40 repeats steps S13 through S16.

On the other hand, when the adjustment value A exceeds (A+5) (YES in S16), the control unit 40 sets an adjustment value having a maximum SA among the corrected detected values SA at S14 as Amax (S17).

In other words, while performing image forming 11 times with the adjustment values ranging from "45" to "55" (corresponding to 11 dots) to form images with the adjustment lines whose positions differ from each other by 1 dot, the control unit 40 performs the operation of detecting the densities of the images.

When the result of the first color registration adjustment is identical with the result shown in FIG. 8A, the coincident point (temporary coincident point) is Amax, and "54" as the adjustment value A is set as Amax.

Next, based on the adjustment value Amax ("54"), the control unit 40 defines a minimum value among four successive values in a range of from a value obtained by subtracting a multiple of 11 from the adjustment value Amax to a value obtained by adding a multiple of 11 to the adjustment value Amax, as an adjustment value B (S21). In other words, among the values from ("54"−"44"="10") to ("54"+"44"="98"), successive values "21", "32", "43" and "54" before "54" are defined as the four successive values. Then, the control unit 40 sets the minimum value "21" among the four successive values as the initial value of the adjustment value B. Thus, here, the adjustment value B is determined by a method in which "21" is obtained by subtracting d×3=33 from the adjustment value Amax.

Next, the control unit 40 forms (prints) the reference patch images at the reference position and forms (prints) the adjustment patch images at the position ("21") of the adjustment value B by using the pattern for detection for use in the second registration (S22), causes the registration detecting sensor 21 to detect the density of an image composed of the reference patch images and adjustment patch images on the transfer belt 7, and reads a detected value SB (S23).

Then, the control unit 40 adds the pitch number 11 of the image forming pattern for use in the first color registration adjustment to the adjustment value B and sets the adjustment value B to "32" (S24), and determines whether or not the adjustment value B exceeds the adjustment value Amax ("54") (S25). Note that since the initial value of the adjustment value B is determined by the above-described method, the adjustment value B is compared with the adjustment value Amax, but it may be compared with a maximum value among the four successive values.

When the adjustment value B does not exceed the adjustment value Amax ("54") (NO in S25), the control unit 40 repeats steps S22 through S25.

On the other hand, when the adjustment value B exceeds the adjustment value Amax (YES in S25), the control unit 40 obtains the adjustment value B having a minimum SB value among the detected values SB read in step S23 and defines it as Bmin (S26).

When the result obtained here is identical with the result shown in FIG. 8B, the first position ("21") has the minimum value, and then it becomes a candidate for the coincident point. At this time, "65" obtained by adding 4d to "21" also becomes a candidate for the coincident point.

Next, in order to determine which one of the "21" and "65" is the true coincident point, the control unit 40 performs the third color registration adjustment.

First, the control unit 40 defines Bmin as an adjustment value C (S31), and forms (prints) the reference patch images at the reference position and forms (prints) the adjustment patch images at the position ("21") of the adjustment value C by using the pattern for detection for the third color registration adjustment (S32).

Then, the control unit 40 causes the registration detecting sensor 21 to detect the density of an image composed of the reference patch images and adjustment patch images on the transfer belt 7, and reads a detected value SC (S33).

Next, the control unit 40 adds the pitch number 44 of the image forming pattern (pattern for detection) for use in the second color registration adjustment to the adjustment value C and sets the adjustment value C to "65" (S34), and then determines whether or not the adjustment value C exceeds the maximum adjustment value "99" (S35).

When the adjustment value C does not exceed the maximum adjustment value "99" (NO in S35), the control unit 40 repeats steps S32 through S35.

On the other hand, when the adjustment value C exceeds the maximum adjustment value "99" (YES in S35), the control unit 40 obtains an adjustment value C having a minimum SC value among the detected values SC read in step S33, and defines it as Cmin (S36).

When the result obtained here is identical with the result shown in FIG. 8C, the second position ("65") has a minimum value and is thus the true coincident point. The control unit 40 stores this value, "65", as the latest adjustment value in the adjustment value storing unit 44 (S37), and returns the sequence.

For other colors to be adjusted, the control unit 40 obtains the adjustment values by performing the color registration adjustments in parallel in the same manner as above, and stores the results in the adjustment value storing unit 44.

Note that the above-described color registration adjustment is an adjustment method for the color registration adjustment performed in the initial stage. In the case where the image forming apparatus is assembled and then set in an environment of actual use, the adjustment is performed at the time of replacement of parts and after maintenance, and adjustment values are stored in the image forming apparatus after the color registration adjustment. Then, the image forming apparatus performs image forming based on the adjustment values. In this case, the first color registration adjustment, the second color registration adjustment, and the third color registration adjustment must be performed as the color registration adjustment.

Further, after the initial color registration adjustment, it is rarely the case that there is a large misregistration when supplying power to the image forming apparatus and performing the color registration adjustment before executing image forming, and therefore, the second color registration adjustment and the third color registration adjustment may be omitted.

It may also be possible to arrange the color registration adjustment to be performed after a predetermined time has elapsed since the supply of power, or after the number of times the image forming performed has exceeded a predetermined number of papers. In this case, there is often almost no misregistration, and therefore the time requiring the color registration adjustment can be significantly shortened by omitting the second color registration adjustment and the third color registration adjustment.

In addition, the color registration adjustment may also be performed when the detected value of the temperature and humidity sensor 22 (see FIG. 1) installed inside the image forming apparatus is out of a preset temperature and humidity range, and when the detected value of the temperature and humidity sensor 22 has changed abruptly,.

Further, when there is noticeable misregistration after maintenance, such as replacement of processing units such as a photoconductor drum and a developing unit, performed by a service person or a user, the user or the service person can force the color registration adjustment to be performed. In these cases, it is also possible to select whether the first, second and third color superposition adjustments are to be fully performed, or only the first color registration adjustment is to be performed.

Note that, when a condition for performing the color registration adjustment is met except for the color registration adjustment at the time of supply of power and the forced color registration adjustment, the color registration adjustment is normally performed after finishing of the image forming job in progress or before the next image forming job is started, instead of executing the color registration adjustment at once.

As described above, according to the image adjustment method of the present invention and the image forming apparatus of the present invention, since the result of detecting the density of the adjustment image can be corrected by taking into account the surface condition of the transfer medium (transfer belt, paper), it is possible to detect the density of the adjustment image highly accurately without being influenced by the surface condition of the transfer medium. Consequently, since a maximum value or a minimum value of the detected values of the density of adjustment images can be easily obtained, it is possible to prevent erroneous color registration adjustment and obtain a correct density detection result in a stable manner. As a result, it is possible to realize an image adjustment method and an image forming apparatus which are capable of shortening the time requiring color registration adjustment and implementing highly accurate color registration adjustment.

Moreover, according to the image adjustment method of the present invention and the image forming apparatus of the present invention, since the transferring means can form an adjustment image at a position where the surface condition of the transfer medium has been known from the detection result of the second detecting means, it is possible to accurately correct the density of the adjustment image.

According to the image adjustment method of the present invention and the image forming apparatus of the present invention, since the output of the first detecting means obtained when detecting the density of the adjustment image is influenced by the surface condition of the transfer medium (transfer belt, paper), a correct density detection result of the adjustment image can be obtained by subtracting the output obtained by detecting the surface condition (density) of the transfer medium with the second detecting means from the output of the first detecting means.

According to the image adjustment method of the present invention and the image forming apparatus of the present invention, it is possible to realize an image adjustment method and an image forming apparatus which are capable of obtaining a correct density detection results in a stable manner, shortening the time requiring color registration adjustment, and implementing highly accurate color registration adjustment.

According to the image adjustment method of the present invention and the image forming apparatus of the present invention, irrespective of the surface condition of the transfer medium which changes every moment with image forming, it is always possible to correct the density of the adjustment image based on a correct surface condition detection result.

According to the image adjustment method of the present invention and the image forming apparatus of the present invention, it is possible to easily detect the density of the adjustment image formed at a position where the surface condition of the transfer medium was detected and equalize the output characteristics related to the detection results, thereby enabling highly accurate density detection.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An image adjustment method for an image forming apparatus, comprising the steps of;

forming an adjustment image by transferring and superposing onto a transfer medium a plurality of reference images formed by a color component to be a reference among a plurality of color components and a plurality of images to be adjusted, which are formed by other color component to be adjusted;

detecting a density of the formed adjustment image; and adjusting an image forming position of the other color component to be adjusted, based on the detected density of the adjustment image, said method further comprising the steps of:

detecting a density of a surface of said transfer medium at an optionally selected position thereon prior to forming the adjustment image every time the adjustment image is formed; and adjusting the image forming position of the other color component, based on the detected density of the surface of said transfer medium and the detected density of said adjustment image;

wherein the adjustment image is formed at the same position as an optionally selected position where the density of the surface of said transfer medium was detected.

2. The image adjustment method as set forth in claim 1, wherein the density of the surface of said transfer medium and the density of the adjustment image are detected by same detecting means.

3. The image adjustment method as set forth in claim 1, wherein the image forming position of the other color component is adjusted based on a difference between the detected density of the adjustment image and the detected density of the surface of said transfer medium.

4. The image adjustment method as set forth in claim 3, wherein the density of the surface of said transfer medium and the density of the adjustment image are detected by same detecting means.

5. The image adjustment method as set forth in claim 3, wherein plural sets of the adjustment images are formed by shifting the reference images and the images to be adjusted from each other by a predetermined distance, and a position where a detected value of density, which varies with a distance of shift between the reference image and the image to be adjusted, has a maximum value or a minimum value that is determined to be the image forming position of the other color component.

6. The image adjustment method as set forth in claim 5, wherein the density of the surface of said transfer medium and the density of the adjustment image are detected by same detecting means.

7. An image forming apparatus comprising:

a plurality of image forming means for forming images by a plurality of color components, respectively;

a plurality of transferring means for transferring the images formed by said plurality of image forming means onto a transfer medium so as to superpose the images;

first detecting means for detecting a density of an adjustment image which is formed by transferring and superposing onto said transfer medium by said plurality of transferring means a plurality of reference images formed by a color component to be a reference among said plurality of color components and a plurality of images to be adjusted, which are formed by other color component to be adjusted; and adjusting means for adjusting an image forming position of the other color component, based on the density detected by said first detecting means, said image forming apparatus further comprising:

second detecting means for detecting a density of a surface of said transfer medium at an optionally selected position thereon prior to the formation of the adjustment image every time the adjustment image is formed by said transferring means, whereby said image adjusting means adjusts the image forming position of the other color component, based on the density detected by said second detecting means and the density of said adjustment image detected by said first detecting means, wherein said transferring means forms the adjustment images at same positions as optionally selected positions where the density of the surface of said transfer medium was detected by said second detecting means.

8. The image forming apparatus as set forth in claim 7, wherein said first detecting means and said second detecting means are same detecting means.

9. The image forming apparatus as set forth in claim 7, wherein said adjusting means adjusts an image forming position of the other color component, based on a difference between the density of the adjustment image detected by said first detecting means and the density of the surface of said transfer medium detected by said second detecting means.

10. The image forming apparatus as set forth in claim 9, wherein said first detecting means and said second detecting means are same detecting means.

11. The image forming apparatus as set forth in claim 9, wherein said transferring means forms plural sets of adjustment images in which the reference images and the images to be adjusted are shifted from each other by a predetermined distance, and said adjusting means determines a position where a detected value of density detected by said first detection means, which varies with a distance of shift between the reference image and the image to be adjusted, has a maximum value or a minimum value to be the image forming position of the other color component.

12. The image forming apparatus as set forth in claim 11, wherein said first detecting means and said second detecting means are same detecting means.

* * * * *